US011735354B2

(12) United States Patent
Mori

(10) Patent No.: US 11,735,354 B2
(45) Date of Patent: Aug. 22, 2023

(54) INDUCTOR AND MANUFACTURING METHOD THEREOF

(71) Applicant: Murata Manufacturing Co., Ltd., Kyoto-fu (JP)

(72) Inventor: Hiroyasu Mori, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 597 days.

(21) Appl. No.: 16/833,214

(22) Filed: Mar. 27, 2020

(65) Prior Publication Data

US 2020/0312533 A1 Oct. 1, 2020

(30) Foreign Application Priority Data

Mar. 28, 2019 (JP) ..... 2019-064651

(51) Int. Cl.
*H01F 27/29* (2006.01)
*H01F 27/28* (2006.01)
(Continued)

(52) U.S. Cl.
CPC ..... *H01F 27/29* (2013.01); *H01F 27/255* (2013.01); *H01F 27/2823* (2013.01);
(Continued)

(58) Field of Classification Search
CPC ..... H01F 27/29; H01F 41/061; H01F 27/255; H01F 27/2823; H01F 27/327; H01F 41/0246
See application file for complete search history.

(56) References Cited

U.S. PATENT DOCUMENTS

2010/0259353 A1* 10/2010 Saito ..... H01F 27/327 336/205
2016/0042859 A1* 2/2016 Park ..... H01F 17/04 336/200
(Continued)

FOREIGN PATENT DOCUMENTS

CN 103366946 A 10/2013
CN 108231339 A 6/2018
(Continued)

OTHER PUBLICATIONS

An Office Action mailed by China National Intellectual Property Administration dated Jul. 9, 2021 which corresponds to Chinese Patent Application No. 20201022850.1 and is related to U.S. Appl. No. 16/833,214 with English language translation.
(Continued)

*Primary Examiner* — Carlos Amaya
(74) *Attorney, Agent, or Firm* — Studebaker & Brackett PC

(57) ABSTRACT

An inductor includes a body including a magnetic body having a coil embedded therein and containing magnetic powder. The coil has a winding portion in which a conductive wire is wound around and has a pair of lead portions taken out from the winding portion. The inductor also includes a pair of outer electrodes formed on the body. In the inductor, each of the lead portions is exposed from at least one side surface of the magnetic body and is coupled to a corresponding outer electrode. In addition, with respect to a position at which each of the lead portions is exposed from the at least one side surface of the magnetic body, a magnetic powder content in a region closer to one of the principal surfaces is higher than a magnetic powder content in a region closer to the other one of the principal surfaces.

6 Claims, 17 Drawing Sheets

(51) Int. Cl.

| | |
|---|---|
| ***H01F 41/02*** | (2006.01) |
| ***H01F 27/255*** | (2006.01) |
| ***H01F 41/061*** | (2016.01) |
| ***H01F 27/32*** | (2006.01) |

(52) U.S. Cl.
CPC ..... *H01F 27/327* (2013.01); *H01F 41/0246* (2013.01); *H01F 41/061* (2016.01)

(56) References Cited

U.S. PATENT DOCUMENTS

| | | | | |
|---|---|---|---|---|
| 2017/0345552 | A1* | 11/2017 | Nakano ..... | H01F 27/2804 |
| 2018/0182531 | A1 | 6/2018 | Muneuchi et al. | |

FOREIGN PATENT DOCUMENTS

| | | | |
|---|---|---|---|
| JP | 2001-267160 | A | 9/2001 |
| JP | 2010-245473 | A | 10/2010 |

OTHER PUBLICATIONS

An Office Action; "Notice of Reasons for Refusal," mailed by the Japanese Patent Office dated Oct. 26, 2021, which corresponds to Japanese Patent Application No. 2019-064651 and is related to U.S. Appl. No. 16/833,214 with English translation.

* cited by examiner

INDUCTOR AND MANUFACTURING METHOD THEREOF

CROSS-REFERENCE TO RELATED APPLICATION

This application claims benefit of priority to Japanese Patent Application No. 2019-064651, filed Mar. 28, 2019, the entire content of which is incorporated herein by reference.

BACKGROUND

Technical Field

The present disclosure relates to an inductor and to a method of manufacturing the inductor.

Background Art

In response to size reduction of electronic devices, the size of inductors is expected to be reduced. A type of inductor provided to aim at the size reduction is configured such that lead portions of a coil disposed in a magnetic body, or terminal electrodes coupled to the lead portions, are taken out and exposed from surfaces of the magnetic body and the exposed portions are coupled to outer electrodes. A method of manufacturing such an inductor may include (i) preparing a first preliminary compact and a second preliminary compact, the first preliminary compact containing magnetic powder and having a notch in a side surface thereof, the second preliminary compact containing magnetic powder to be disposed on the first preliminary compact, (ii) disposing a coil in the first preliminary compact in such a manner that lead portions are taken out of the first preliminary compact through the notch, (iii) forming a magnetic body by disposing the first preliminary compact having the coil disposed therein and the second preliminary compact, in a molding die, and by pressing the first preliminary compact and the second preliminary compact into one body using the molding die as described, for example, in Japanese Unexamined Patent Application Publication No. 2001-267160.

However, in this manufacturing method, the notch of the first preliminary compact may be filled insufficiently with magnetic powder in the pressing step, which may leave an unfilled part of the notch on the surface of the magnetic body produced by pressing the first preliminary compact and the second preliminary compact into one body. As a result, excluding a portion coupled to the outer electrodes, part of the coil may be exposed from the magnetic body and such part of the coil may be in contact with the outer electrodes, thereby causing a short circuit in an inductor product.

SUMMARY

Accordingly, the present disclosure provides an inductor that can suppress the occurrence of a short circuit between outer electrodes and part of the coil not expected to be in contact with the outer electrodes. The present disclosure also provides a method of manufacturing the inductor.

According to an aspect of the present disclosure, an inductor includes a body including a magnetic body containing magnetic powder and a coil embedded in the magnetic body. The coil has a winding portion in which a conductive wire is wound around and a pair of lead portions taken out from the winding portion. The inductor also includes a pair of outer electrodes formed on the body. In the inductor, the magnetic body includes principal surfaces being opposite to each other and multiple side surfaces adjacent to the principal surfaces, and at least part of each of the lead portions is exposed from at least one side surface of the magnetic body and is coupled to a corresponding one of the outer electrodes. In addition, with respect to a position at which each of the lead portions is exposed from the at least one side surface of the magnetic body, a magnetic powder content in a region closer to one of the principal surfaces is higher than a magnetic powder content in a region closer to the other one of the principal surfaces.

According to another aspect of present disclosure, a method of manufacturing an inductor includes (i) preparing a first preliminary compact and a second preliminary compact, the first preliminary compact including a recess, a winding core formed in the recess, and at least one notch formed in at least one side wall defining the recess, the second preliminary compact being shaped like a flat plate and having at least one projection portion extending along an edge of the second preliminary compact. The method also includes (ii) disposing, in a first preliminary compact, a coil that has a winding portion being formed so as to wind a conductive wire around and has lead portions being taken out from the winding portion, the coil being disposed in such a manner that the winding portion is disposed around the winding core and that end portions of the lead portions are taken out through the at least one notch and are disposed on at least one side surface of the first preliminary compact. The method further includes (iii) forming a body that includes a magnetic body having the coil embedded therein and containing magnetic powder, the body being formed by placing the second preliminary compact in such a manner that the second preliminary compact covers the recess of the first preliminary compact and the at least one projection portion opposes the at least one notch and by pressing the first preliminary compact and the second preliminary compact against each other in a molding die, and (iv) forming outer electrodes on surfaces of the body and coupling the outer electrodes to respective ones of the end portions.

According to still another aspect of the present disclosure, a method of manufacturing an inductor includes (i) preparing a first preliminary compact and a second preliminary compact, the first preliminary compact including a recess, a winding core formed in the recess, and at least one notch formed in at least one side wall defining the recess, the second preliminary compact being shaped like a flat plate and having at least one high magnetic powder content region extending along an edge of the second preliminary compact, the at least one high magnetic powder content region having a magnetic content higher than that of the other region. The method also includes (ii) disposing, in a first preliminary compact, a coil that has a winding portion being formed so as to wind a conductive wire around and has lead portions being taken out from the winding portion, the coil being disposed in such a manner that the winding portion is disposed around the winding core and that end portions of the lead portions are taken out through the at least one notch and are disposed on at least one side surface of the first preliminary compact. The method further includes (iii) forming a body that includes a magnetic body having the coil embedded therein and containing magnetic powder, the body being formed by placing the second preliminary compact in such a manner that the second preliminary compact covers the recess of the first preliminary compact and the at least one high magnetic powder content region opposes the at least one notch and by pressing the first preliminary compact and the second preliminary compact against each other in a molding die, and (iv) forming outer electrodes on surfaces of the body and coupling the outer electrodes to respective ones of the end portions.

According to an aspect of the present disclosure, there is provided an inductor that can suppress the occurrence of a short circuit between outer electrodes and part of the coil not expected to be in contact with the outer electrodes. According to another aspect of the present disclosure, a method of manufacturing the inductor is provided.

Other features, elements, characteristics and advantages of the present disclosure will become more apparent from the following detailed description of preferred embodiments of the present disclosure with reference to the attached drawings.

DETAILED DESCRIPTION

Figure 1:
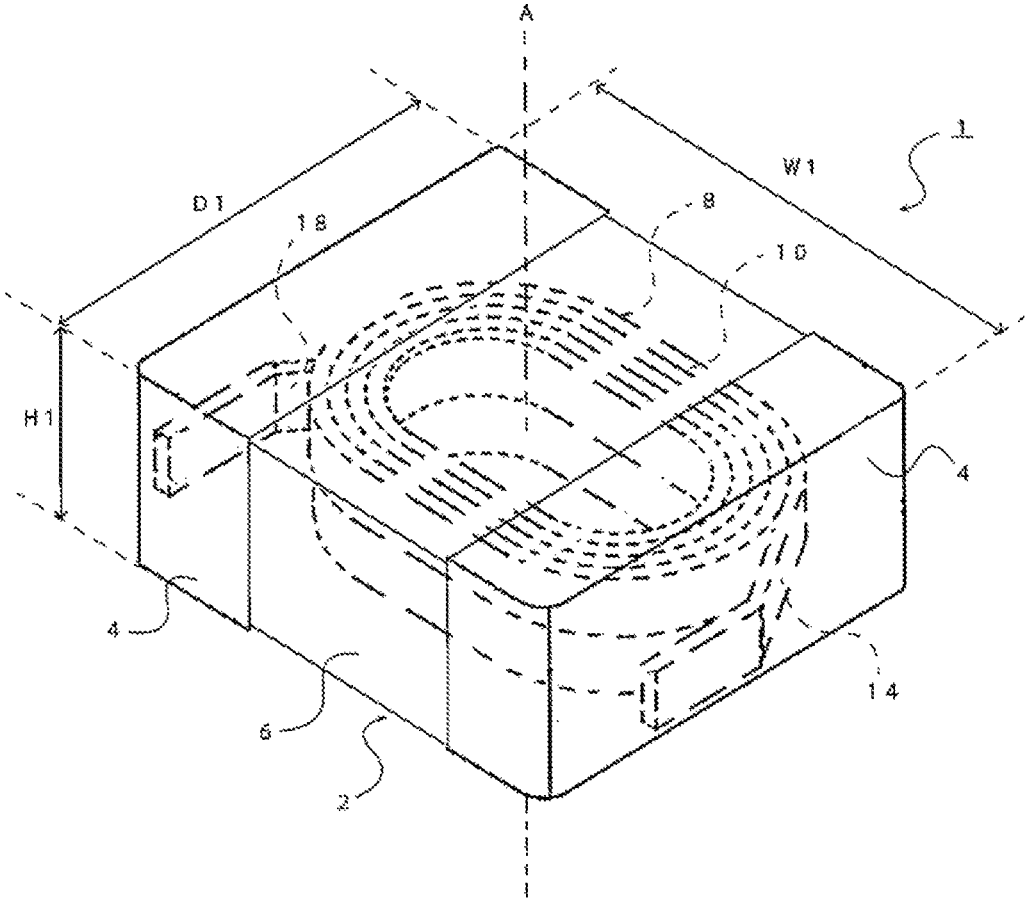
FIG. 1 is a perspective view illustrating an inductor according to a first embodiment of the present disclosure.

Embodiments and examples for implementing the present disclosure will be described with reference to the drawings. Note that an inductor described below is an example for realizing the technical idea of the present disclosure, and accordingly the present disclosure is not limited to the inductor described below unless expressly stated otherwise.

In the drawings, elements having the same function may be denoted by the same reference symbol. Different embodiments and examples may be described separately for convenience for the sake of explaining main points and facilitating a clear understanding. However, the different embodiments and examples can be partially replaced by or partially combined with each other. Embodiments and examples described later are based on the preceding description of embodiments, and accordingly only differences will be described and duplicated description will be omitted. Advantageous effects obtained by using a similar configuration will not be described repeatedly for each embodiment or example. Sizes and positional relationships of members in the drawings may be exaggerated to facilitate a clear understanding. Terms related to specific directions and specific positions will be used when necessary in the following description (for example, "up", "down", "right", "left", "up-down (height) direction", "horizontal direction", etc., and other terms containing such meanings). These terms are used for the sake of facilitating a clear understanding of the disclosure when these features are described with reference to the drawings. However, these terms are not intended to limit the technical scope of the present disclosure.

As described in the background, the notch of the first preliminary compact may not be sufficiently filled with the magnetic powder in the pressing step. The reason for this, according to the present inventors, is that in the pressing step, the distance of migration of the magnetic powder depends on the amount of pressure applied, but the pressure to be applied is limited to avoid deformation of the coil embedded therein. As a result, the magnetic powder is not moved sufficiently to the notch. To solve the above problem, the inventors have tried, in the pressing step, to create a condition in which the magnetic powder is present at a high concentration in the vicinity of the notch.

Embodiments of the present disclosure, which are based on the above idea and attempts, will be described below.

1. First Embodiment

Figure 2:
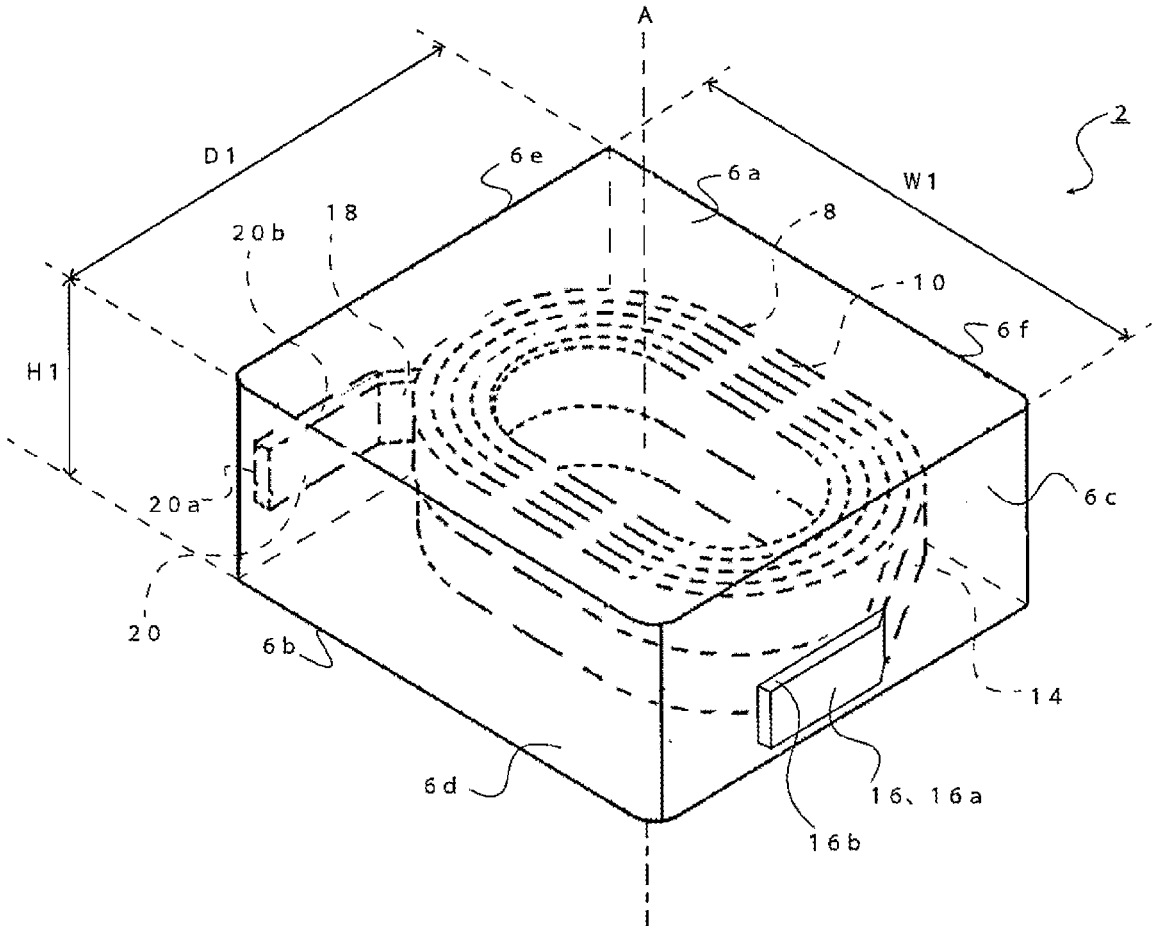
FIG. 2 is a perspective view illustrating a body of inductor of FIG. 1.

An inductor according to a first embodiment of the present disclosure will be described with reference to FIGS. 1 and 2. FIG. 1 is a perspective view illustrating an inductor 1 according to the first embodiment of the present disclosure. FIG. 2 is a perspective view illustrating a body 2 of inductor 1 of FIG. 1.

The inductor 1 includes a body 2 that has a magnetic body 6 containing magnetic powder and having a coil 8 embedded therein, and also includes a pair of outer electrodes 4 formed on surfaces of the body 2. The magnetic body 6 is shaped like a cuboid having two principal surfaces 6*a* and 6*b* being opposite to each other and multiple side surfaces 6*c*, 6*d*, 6*e*, and 6*f* (four surfaces in the present embodiment). The coil 8 includes a winding portion 10 in which a conductive wire is wound around and also includes a pair of lead portions 14 and 18 that are taken out from the winding portion 10. At least part of each of the lead portions 14 and 18 is exposed from a side surface of the magnetic body 6 and coupled to an outer electrode 4. The magnetic powder content is distributed in the magnetic body 6 in such a manner that with respect to the position at which each of the lead portions 14 and 18 is exposed from the corresponding side surface of the magnetic body 6, a region of the magnetic body 6 adjacent to one of the principal surfaces 6*a* and 6*b* has a higher magnetic powder content than a region of the magnetic body 6 adjacent to the other one of the principal surfaces 6*a* and 6*b*.

The following describes each component in detail.

Body

The body 2 includes the coil 8 and the magnetic body 6. The coil 8 is embedded in the magnetic body 6.

Magnetic Body

The magnetic body 6 has an external appearance like a cuboid. The magnetic body 6 has the upper principal surface 6*a* and the lower principal surface 6*b* each of which is shaped like a rectangle having longitudinal sides and lateral sides. The magnetic body 6 has two longitudinal side surfaces 6*d* and 6*f* and two lateral side surfaces 6*c* and 6*e*. The longitudinal length W1 of the magnetic body 6 is, for example, approximately 2 to 12 mm, and the lateral length D1 thereof is, for example, approximately 2 to 12 mm. The height H1 of the magnetic body 6 is, for example, 1 to 6 mm.

The magnetic body 6 is formed by pressing a mixture of magnetic powder and resin. The magnetic powder content of the mixture is, for example, 60% by weight or more, preferably 80% by weight or more. A type of magnetic powder to be used may be an iron-based magnetic powder composed of, for example, Fe, Fe—Si—Cr, Fe—Ni—Al, Fe—Cr—Al, Fe—Si, Fe—Si-A, Fe—Ni, or Fe—Ni—Mo, an other metal-based magnetic powder, an amorphous metal-based magnetic powder, a magnetic powder of which surfaces of metal particles are coated with an insulator such as glass, a magnetic powder of which surfaces of metal particles are modified, or a magnetic powder composed of nano-level minute metal particles. A type of resin to be used may be a thermosetting resin, such as epoxy resin, polyimide resin, and phenol resin, or a thermoplastic resin, such as polyethylene resin and polyamide resin.

Coil

The coil 8 includes the winding portion 10 in which a conductive wire is wound around and a pair of the lead portions 14 and 18 that are taken out from the outer circumference of the winding portion 10. The conductive wire is a so-called flat wire having a pair of wide surfaces and having a cross section shaped like a rectangle. The conductive wire has a cover layer having insulation properties and formed on the surface of the wire and has a fusing layer formed on the surface of the cover layer.

In the winding portion 10, the conductive wire is wound in upper and lower sections in such a manner that both end portions of the conductive wire are taken out from the outer circumference of the winding portion 10 and a portion of the conductive wire wound in the upper section is connected to a portion wound in the lower section at the inner circumference of the winding portion 10. The lead portion 14 is taken out from the outer circumference of upper section of the winding portion 10 and positioned in an upper region, whereas the lead portion 18 is taken out from the outer circumference of lower section of the winding portion 10 and is positioned in a lower region. The winding portion 10 is disposed in the magnetic body 6 in such a manner that the central axis of winding of the winding portion 10 corresponds to a central axis A of the inductor 1 positioned at the center thereof and extending in the up-down direction. The conductive wire is wound in the winding portion 10 in such a manner that the wide surfaces of the conductive wire are disposed substantially parallel to the extending direction of the central axis A of the inductor 1. Accordingly, the lead portions 14 and 18 are taken out in the horizontal direction with respect to the inductor 1 in the state in which respective wide surfaces are substantially parallel to the extending direction of the central axis A.

An end portion 16 of the lead portion 14 is exposed from the lateral side surface 6*c* of the magnetic body 6. The lead portion 14 is bent inside the body 2 in such a manner that a wide surface 16*a* of the end portion 16 can be disposed on the lateral side surface 6*c* of the magnetic body 6.

Similarly, an end portion 20 of the lead portion 18 is exposed from the lateral side surface 6*e* of the magnetic body 6. The lead portion 18 is bent inside the body 2 in such a manner that a wide surface 20*a* of the end portion 20 can be disposed on the lateral side surface 6*e* of the magnetic body 6.

Figure 3:
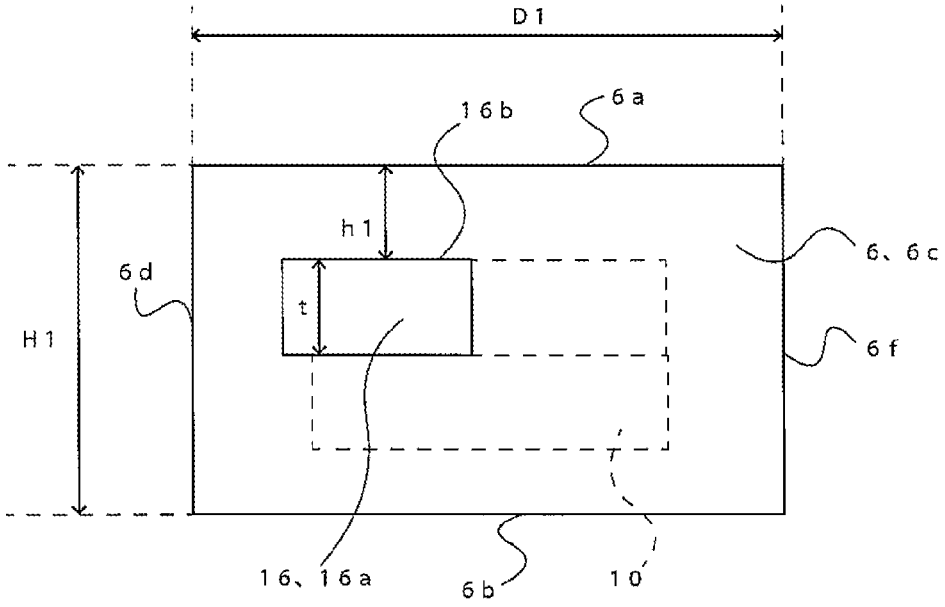
FIG. 3 is a side view illustrating a side of body of FIG. 2 from which a lead portion is taken out.
Figure 4:
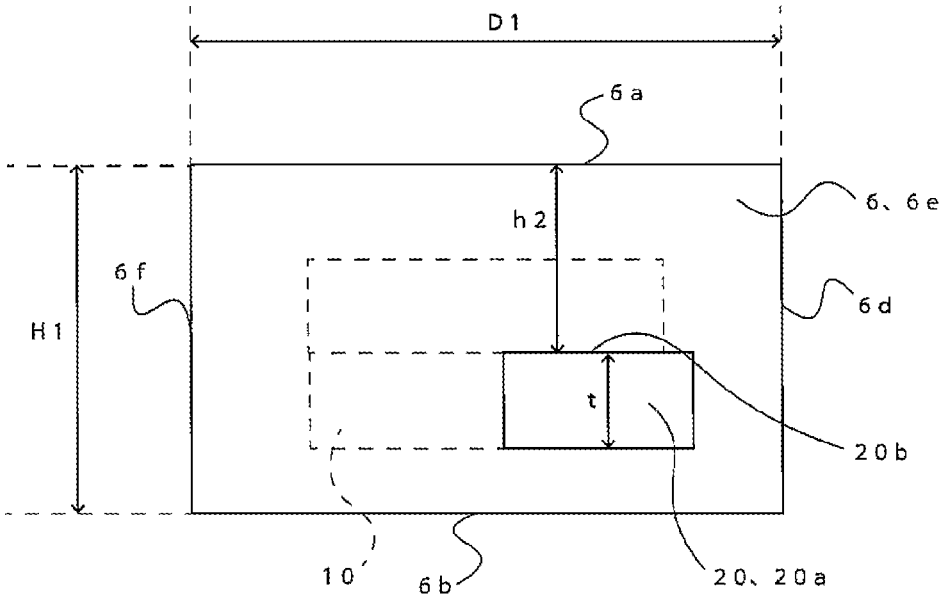
FIG. 4 is a side view illustrating another side of body of FIG. 2 from which another lead portion is taken out.

With reference to FIGS. 3 and 4, the following describes the positions at which respective end portions 16 and 20 of the lead portions 14 and 18 are exposed on the corresponding lateral side surfaces 6*c* and 6*e*. FIG. 3 is a side view illustrating a side of body 2 of FIG. 2, from which the lead portion 14 is taken out. FIG. 4 is a side view illustrating another side of body 2 of FIG. 2, from which the lead portion 18 is taken out.

As described, the lead portions 14 and 18 having respective end portions 16 and 20 are taken out from the winding portion 10 in such a manner that the wide surfaces are substantially parallel to the central axis A. The end portion 16 has a side surface 16*b* that is a surface positioned closer to the upper principal surface 6*a* of the magnetic body 6, while the end portion 20 has a side surface 20*b* that is a surface positioned closer to the upper principal surface 6*a*. The side surfaces 16*b* and 20*b* are substantially parallel to the upper principal surface 6*a* of the magnetic body 6. The side surface 16*b* of end portion 16 of the lead portion 14 is located on the lateral side surface 6*c* of the magnetic body 6 at a position away by a length h1 from the upper principal surface 6*a* of the magnetic body 6 (see FIG. 3). The side surface 20*b* of end portion 20 of the lead portion 18 is located on the lateral side surface 6*e* of the magnetic body 6 at a position away by a length h2 from the upper principal surface 6*a* of the magnetic body 6 (see FIG. 4). When reference symbol t denotes the width of the conductive wire, the relationship between the length h1 and the length h2 is substantially h2=h1+t.

As described above, the wide surfaces 16*a* and 20*a* of the end portions 16 and 20 are exposed from respective lateral side surfaces 6*c* and 6*e* of the magnetic body 6. The wide surfaces 16*a* and 20*a*, from which the cover layer and the fusing layer are removed, are coupled to the outer electrodes 4.

A conductor of the conductive wire that forms the coil 8 has a width (width of the wide surface) of, for example, 120 μm or more and 2800 μm or less (i.e., from 120 μm to 2800 μm) and a thickness (measured in the direction substantially perpendicular to the wide surface) of, for example, 10 μm or more and 2000 μm or less (i.e., from 10 μm to 2000 μm). The cover layer has a thickness of, for example, 2 μm or more and 10 μm or less (i.e., from 2 μm to 10 μm), preferably approximately 6 μm. The cover layer is made of an insulating resin, such as polyamide-imide. The fusing layer has a thickness of, for example, 1 μm or more and 3 μm or less (i.e., from 1 μm to 3 μm). The fusing layer is made of a thermoplastic resin or a thermosetting resin and includes an autohesion ingredient for fixing conductive wires of the winding portion to each other.

Magnetic Powder Content

Figure 5:
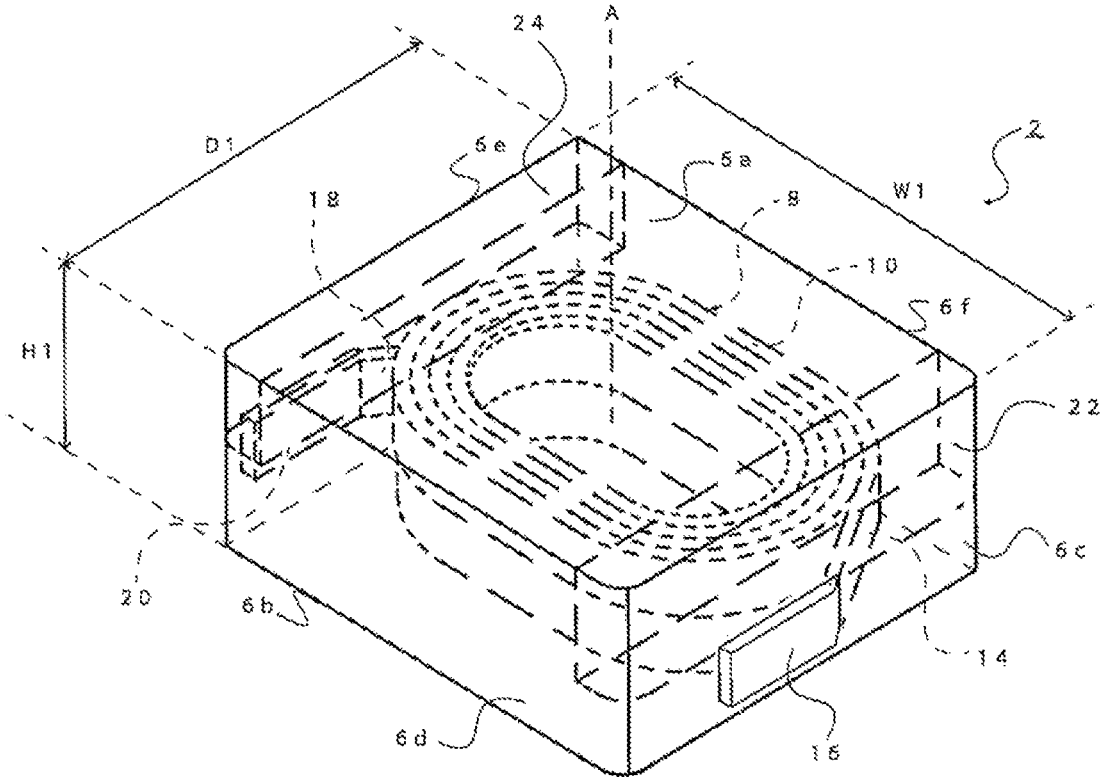
FIG. 5 is a perspective view for explanation of a first region and a second region of the body of inductor of FIG. 1.
Figure 6:
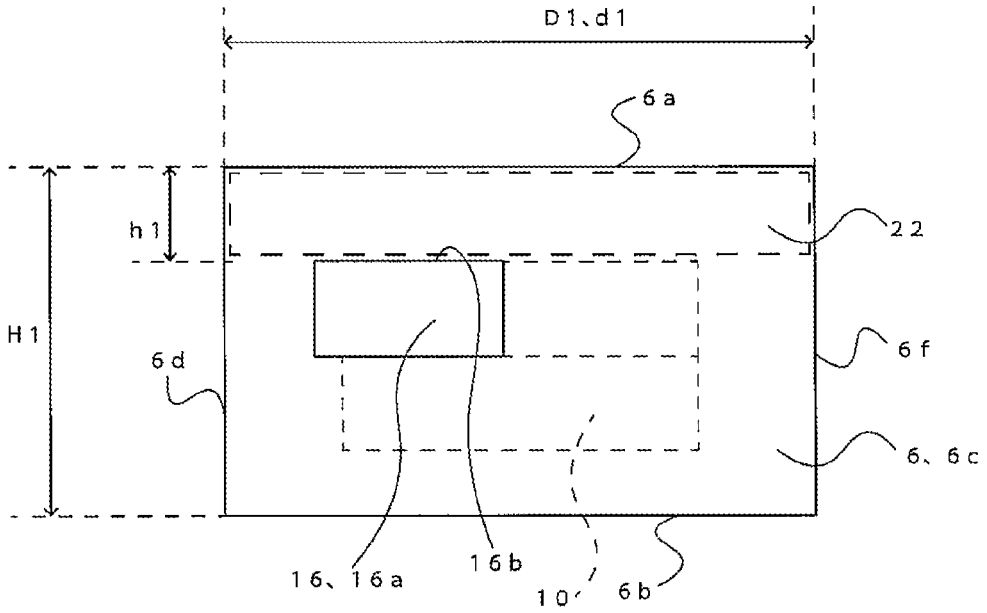
FIG. 6 is a side view illustrating the body of FIG. 5.
Figure 7:
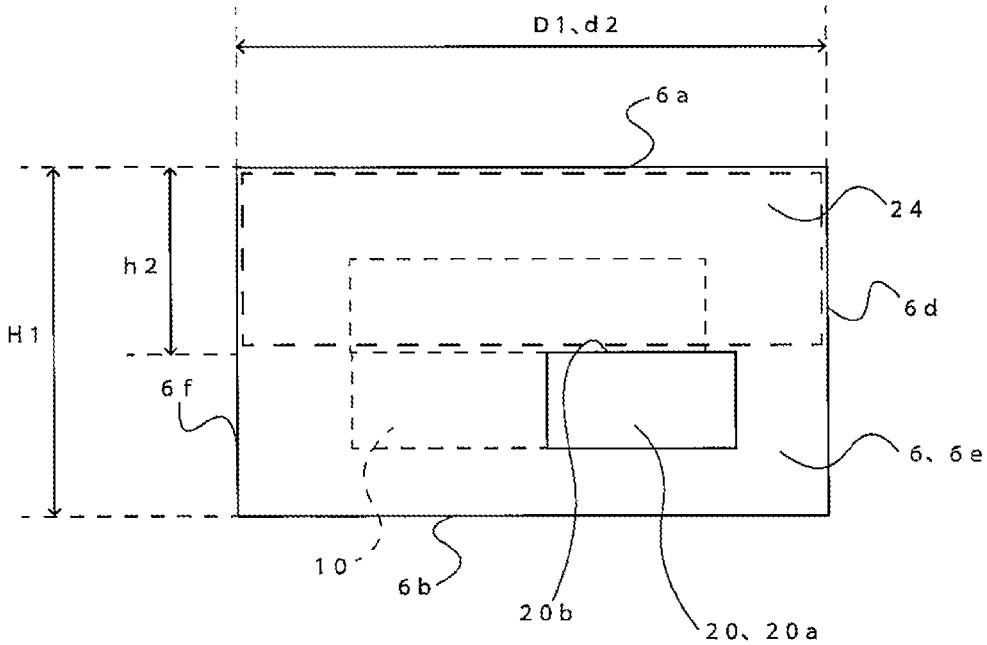
FIG. 7 is another side view illustrating the body of FIG. 5.
Figure 8:
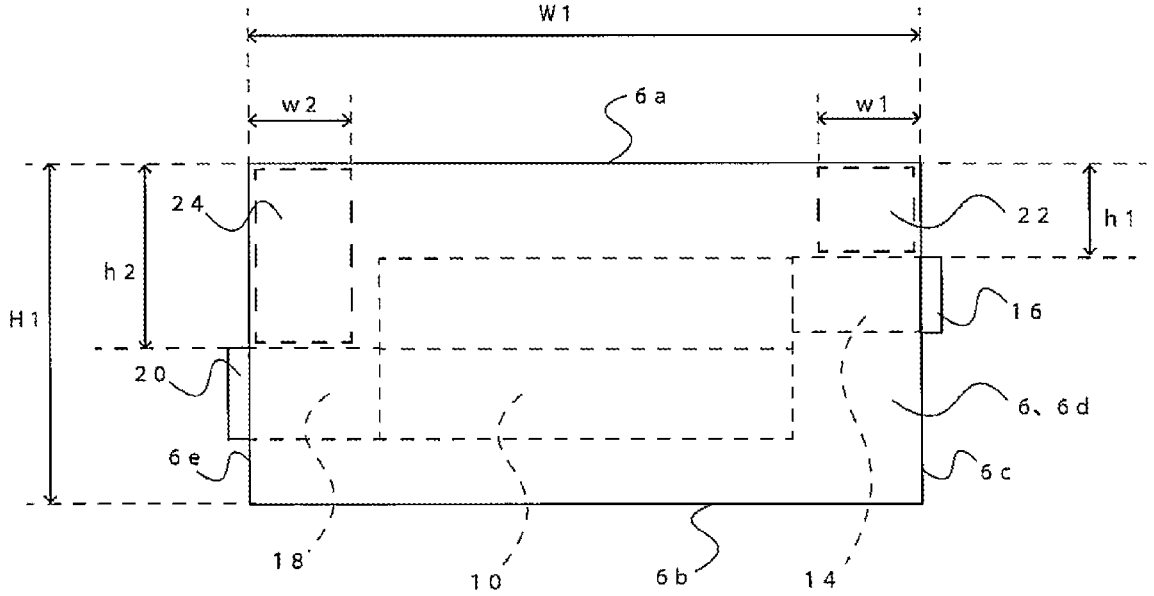
FIG. 8 is a front view illustrating the body of FIG. 5.
Figure 9:
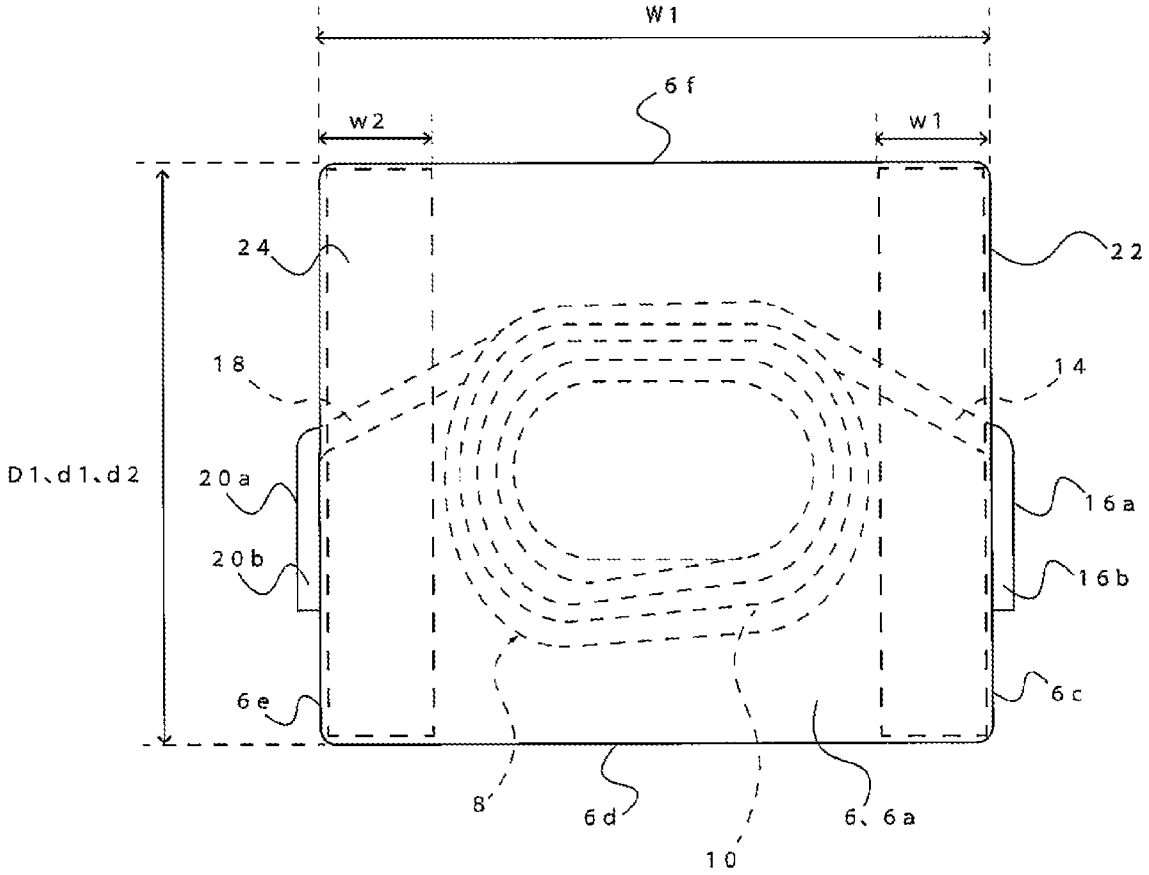
FIG. 9 is a top view illustrating the body of FIG. 5.

Next, referring to FIGS. 5 to 9, the distribution of the magnetic powder in the magnetic body 6 will be described by focusing on the magnetic powder content. FIG. 5 is a perspective view provided for explaining a first region 22 and a second region 24 of body 2 of inductor 1 of FIG. 1. FIGS. 6 and 7 are side views illustrating the body 2 of FIG. 5. FIG. 8 is a front view illustrating the body 2 of FIG. 5. FIG. 9 is a top view illustrating the body 2 of FIG. 5.

In the magnetic body 6, the first region 22 is disposed so as to include the corners formed by the lateral side surface 6*c* and the upper principal surface 6*a*, and the second region 24 is disposed so as to include the corners formed by the lateral side surface 6*e* and the upper principal surface 6*a*. The magnetic powder content in the first region 22 and in the second region 24 is higher than that of rest of the magnetic body 6. As indicated by a broken line in FIG. 5, the first region 22 and the second region 24 are each shaped like a quadrangular prism that has a substantially rectangular bottom surface (or an upper surface) at the longitudinal side surface 6*d* (or 6*f*) and that extends in the lateral direction of the magnetic body 6.

A length d1 of the first region 22 in the lateral direction of the magnetic body 6 (hereinafter referred to as the "depth direction") corresponds to a length D1 of the magnetic body 6 in the depth direction (see FIGS. 6 and 9). A length w1 of the first region 22 in the longitudinal direction of the magnetic body 6 (hereinafter referred to as the "width direction") is ⅙ or more and ⅓ or less (i.e., from ⅙ to ⅓) of a length W1 of the magnetic body 6 in the width direction (see FIGS. 8 and 9). The length of the first region 22 in the height direction is a length h1 from the upper principal surface 6*a* to the side surface 16*b* of end portion 16 of the lead portion 14 that is taken out from the coil 8 and exposed from the lateral side surface 6*c* of the magnetic body 6 (see FIGS. 6 and 8). In other words, the first region 22 is shaped like a cuboid having dimensions of w1×h1×d1.

A length d2 of the second region 24 in the depth direction corresponds to the length D1 of the magnetic body 6 in the depth direction (see FIGS. 6 and 9). A length w2 of the second region 24 in the width direction is ⅙ or more and ⅓ or less (i.e., from ⅙ to ⅓) of the length W1 of the magnetic body 6 in the width direction (see FIGS. 8 and 9). The length of the second region 24 in the height direction is a length h2 from the upper principal surface 6*a* to the side surface 20*b* of end portion 20 exposed from the lateral side surface 6*e* of the magnetic body 6. In other words, the second region 24 is shaped like a cuboid having dimensions of w2×h2×d2.

The magnetic powder content of the first region 22 and second region 24 is approximately 1% to 3% higher than that of other regions in the magnetic body 6. The magnetic powder content can be determined, for example, by taking scanning electron microscope (SEM) images of corresponding surfaces in the upper principal surface of the magnetic body 6 (for example, using a digital microscope (available from KEYENCE) with 500 times magnification) and subsequently by converting the images into binary using an image processing software program (for example, using GIMP (developed by Spencer Kimball, Peter Mattis and the GIMP Development Team)). A binarized image has white and black regions, and the white regions correspond to regions in which magnetic powder is present. Accordingly, the density of the magnetic powder can be estimated from the SEM image by calculating the ratio of area of the white regions to the entire target area.

Outer Electrode

One of the paired outer electrodes 4 is disposed so as to cover the end portion 16, the lateral side surface 6*c* from which the end portion 16 is exposed, part of each of the principal surfaces 6*a* and 6*b*, and part of each of the longitudinal side surfaces 6*d* and 6*f*. The other outer electrode 4 is disposed so as to cover the end portion 20, the lateral side surface 6*e* from which the end portion 20 is exposed, part of each of the principal surfaces 6*a* and 6*b*, and part of each of the longitudinal side surfaces 6*d* and 6*f*. The end portions 16 and 20 are electrically connected to the corresponding outer electrodes 4.

Advantageous Effect

The inductor 1 configured as described above includes a region (the first region 22) that includes part of the lateral side surface 6*c* from which the end portion 16 of the lead portion 14 is exposed and that is located closer to one of the principal surfaces (the upper principal surface 6*a*) than to the other principal surface from a position at which the end portion 16 is exposed from the lateral side surface 6*c*. The inductor 1 includes another region (the second region 24) that includes part of the lateral side surface 6*e* from which the end portion 20 of the lead portion 18 is exposed and that is located closer to one of the principal surfaces (the upper principal surface 6*a*) than to the other principal surface from a position at which the end portion 20 is exposed from the lateral side surface 6*e*. The magnetic powder content of the two regions (the first region 22 and the second region 24) is higher than that of the other regions in the inductor 1. As a result, border regions of respective end portions 16 and 20 exposed from the lateral side surfaces 6*c* and 6*e*, which come into contact with the magnetic body 6, are sufficiently covered by the magnetic body 6. Accordingly, the magnetic body 6 covers the entire coil 8 except for the end portions 16 and 20. Thus, the outer electrodes 4 are prevented from coming into contact with the coil 8 except for the end portions 16 and 20, which can reduce the likelihood of the inductor 1 being short-circuited.

In addition, in the inductor 1 configured as above, the first region 22 and the second region 24 having a high magnetic powder content have limited dimensions. Thus, the consumption of magnetic powder can be limited, which leads to a reduction in manufacturing cost.

Moreover, in the inductor 1 configured as above, the end portions 16 and 20 of the lead portions of the coil 8 are exposed from respective lateral side surfaces 6*c* and 6*e* of the magnetic body 6, and the lateral side surfaces 6*c* and 6*e* are covered by the outer electrodes 4. Accordingly, the distance between the end portions 16 and 20 of the corresponding paired lead portions can be made greater compared with the case in which the end portions 16 and 20 of the corresponding paired lead portions are exposed from the longitudinal side surfaces of the magnetic body 6, which improves the withstanding voltage capacity of the inductor 1.

In the inductor 1 configured as above, the lead portions 14 and 18 are exposed from respective lateral side surfaces 6*c* and 6*e* of the magnetic body 6, and high magnetic powder content regions are disposed in the vicinities of the lateral side surfaces 6*c* and 6*e*. However, for example, the lead portions 14 and 18 may be exposed from respective longitudinal side surfaces 6*d* and 6*f* of the magnetic body 6, and high magnetic powder content regions are disposed in the vicinities of the longitudinal side surfaces 6*d* and 6*f*.

2. Second Embodiment

Figure 10:
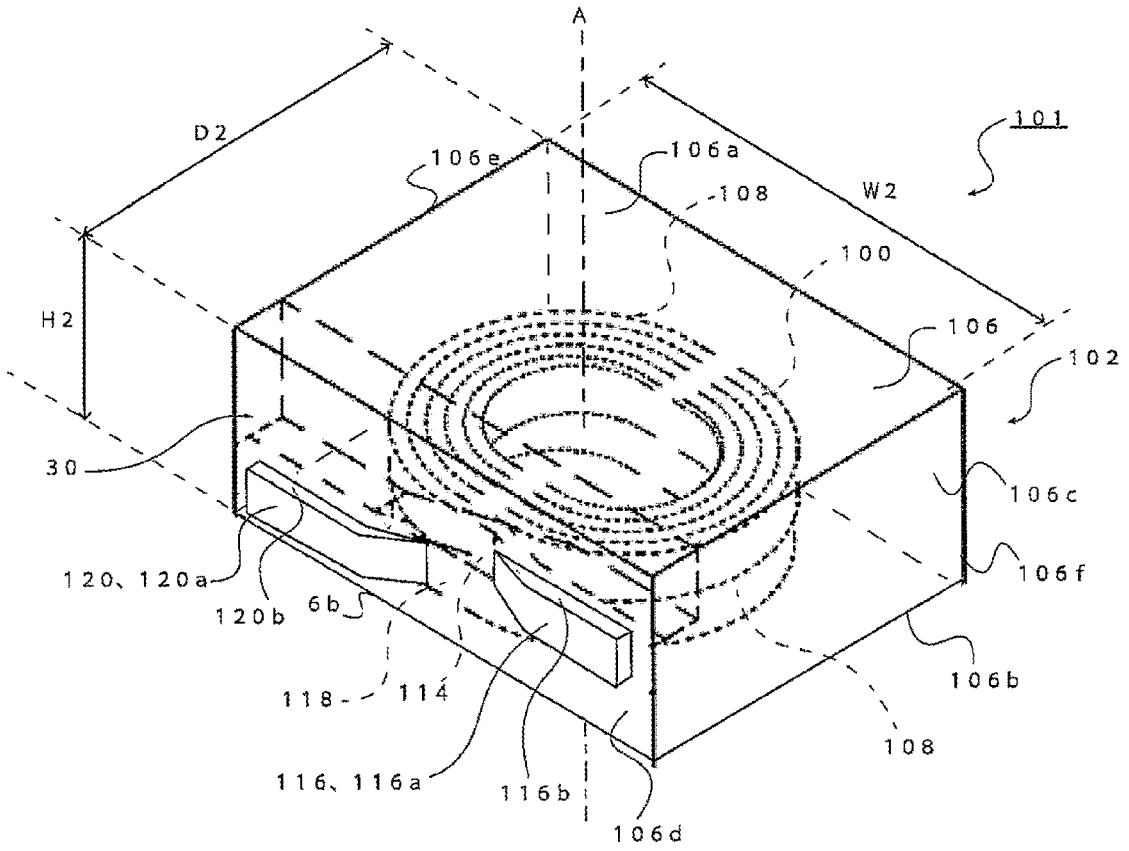
FIG. 10 is a perspective view for explanation of a coil and a third region of body of an inductor according to a second embodiment of the present disclosure.

Next, an inductor 101 according to a second embodiment will be described with reference to FIG. 10. FIG. 10 is a perspective view provided for explaining a coil 108 and a third region 30 of a body 102 of the inductor 101 according to the second embodiment of the present disclosure. The inductor 101 is different from the inductor 1 of the first embodiment in that end portions 116 and 120 of respective paired lead portions 114 and 118 are exposed only from a longitudinal side surface 106*d* of a magnetic body 106 in the inductor 101. Moreover, a high magnetic powder content region is disposed differently from the inductor 1 of the first embodiment. The differences from the inductor 1 of the first embodiment will be described in detail below.

The end portions 116 and 120 of respective lead portions 114 and 118 that are taken out from a winding portion 100 are both exposed from the longitudinal side surface 106*d* of the magnetic body 106. The lead portions 114 and 118 are bent inside the magnetic body 106 in such a manner that wide surfaces 116*a* and 120*a* of the corresponding end portions 116 and 120 can be disposed on the longitudinal side surface 106*d*.

Figure 11:
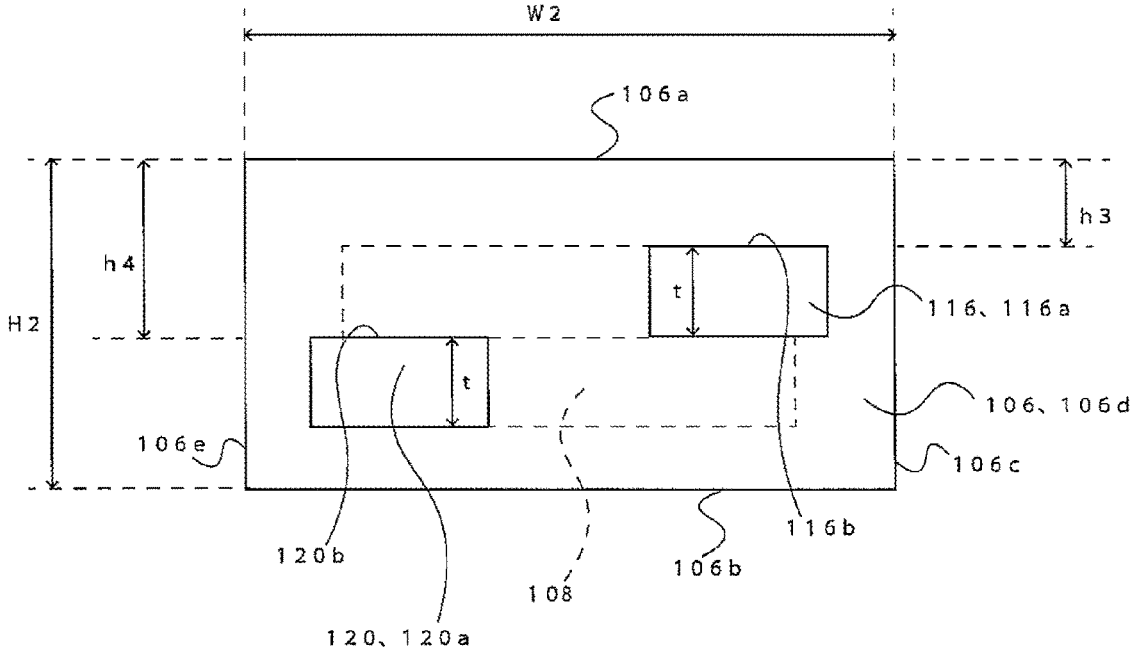
FIG. 11 is a front view illustrating the body of inductor of FIG. 10.

With reference to FIG. 11, the following describes the positions at which the end portions 116 and 120 of respective lead portions 114 and 118 are exposed from the longitudinal side surface 106*d*. FIG. 11 is a front view illustrating the body 102 of inductor 101 of FIG. 10.

In the present embodiment, the lead portions 114 and 118 having respective end portions 116 and 120 are taken out from the winding portion 100 in such a manner that the width direction of each wide surface is substantially parallel to the central axis A. The end portions 116 and 120 have respective side surfaces 116*b* and 120*b* both of which are positioned closer to the upper principal surface 106*a* than to the lower principal surface 106*b*, and the side surfaces 116*b* and 120*b* are substantially parallel to the upper principal surface 106*a*. The side surface 116*b* of end portion 116 of the lead portion 114 is located on the longitudinal side surface 106*d* of the magnetic body 106 at a position away by a length h3 from the upper principal surface 106*a* of the magnetic body 106. The side surface 120*b* of end portion 120 of the lead portion 118 is located on the longitudinal side surface 106*d* of the magnetic body 106 at a position away by a length h4 from the upper principal surface 106*a* of the magnetic body 106 (see FIG. 11). When reference symbol t denotes the width of the conductive wire, the relationship between the length h3 and the length h4 is substantially h4=h3+t.

As described above, the end portions 116 and 120 are exposed from the longitudinal side surface 106*d* of the magnetic body 106. The end portions 116 and 120, from which the cover layer and the fusing layer are removed, are coupled to paired outer electrodes (not illustrated) that are disposed so as to cover lateral side surfaces 106*c* and 106*e*, part of each of principal surfaces 106*a* and 106*b*, and part of each of longitudinal side surfaces 106*d* and 106*f*.

Magnetic Powder Content

Figure 12:
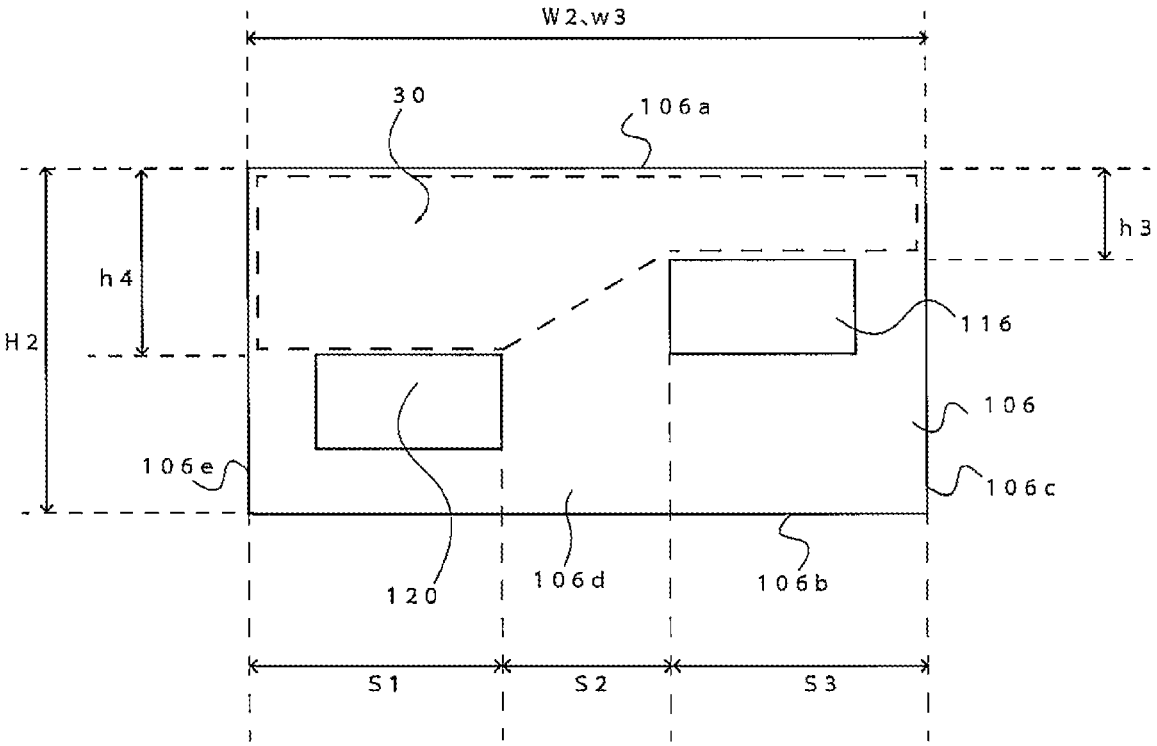
FIG. 12 is a front view for explanation of the coil and the third region of body of inductor of FIG. 10.
Figure 13:
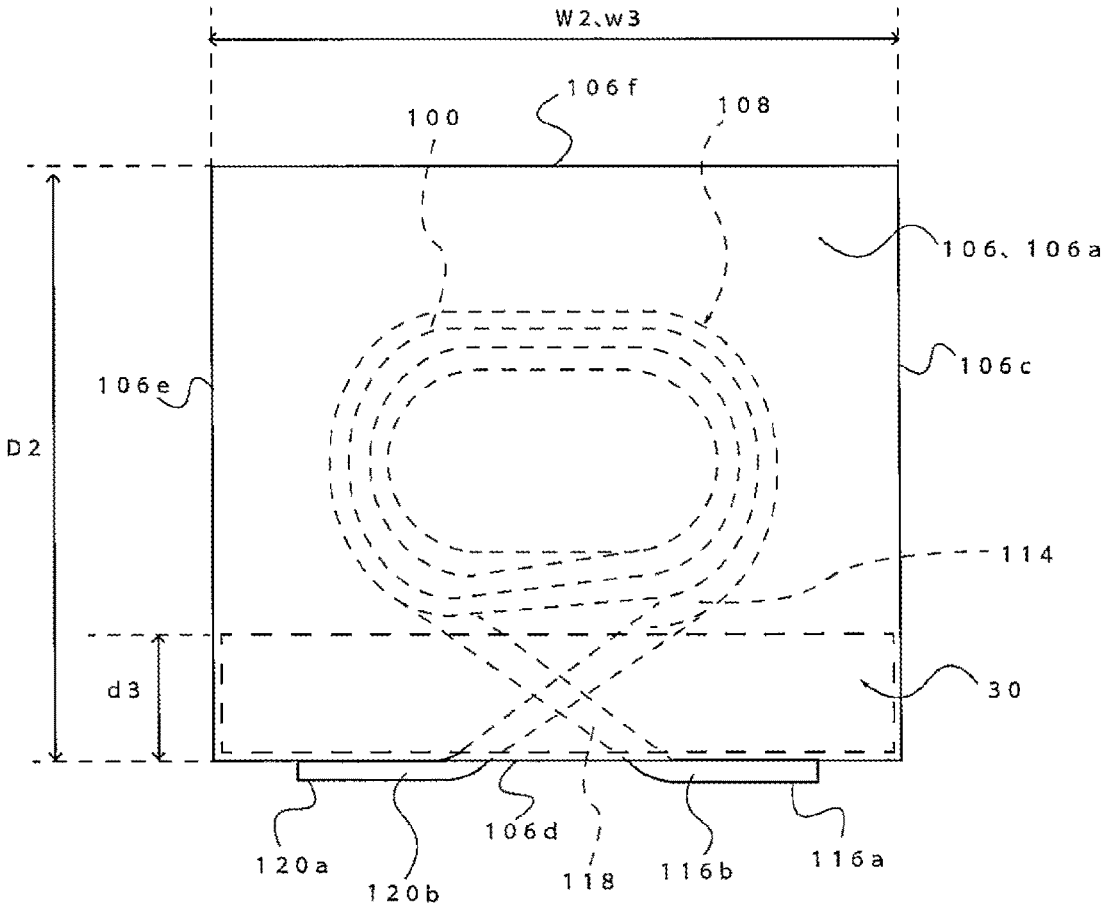
FIG. 13 is a top view for explanation of the coil and the third region of body of inductor of FIG. 10.
Figure 14:
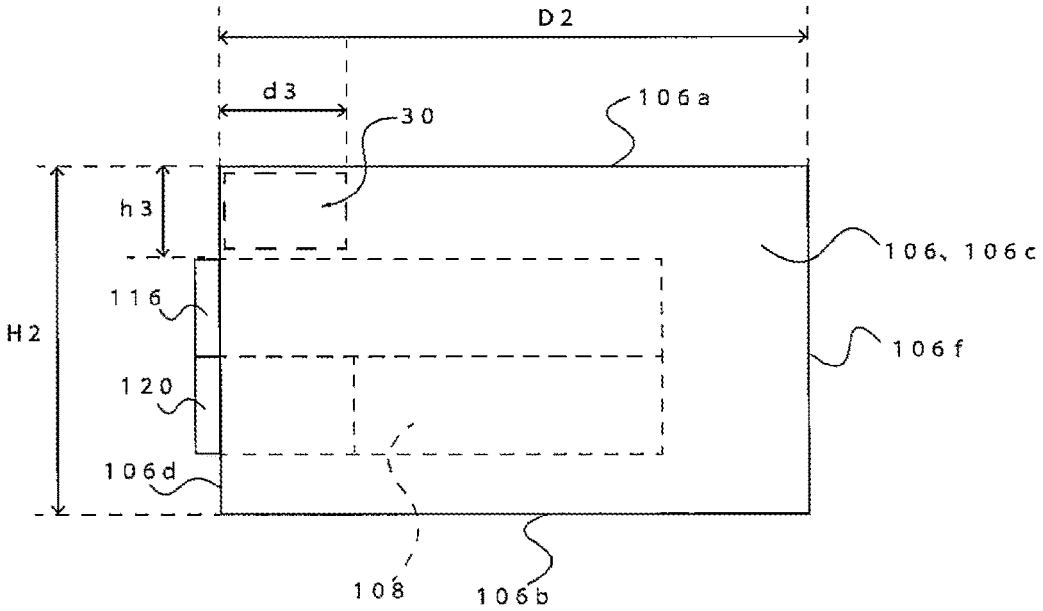
FIG. 14 is a side view for explanation of the coil and the third region of body of inductor of FIG. 10.
Figure 15:
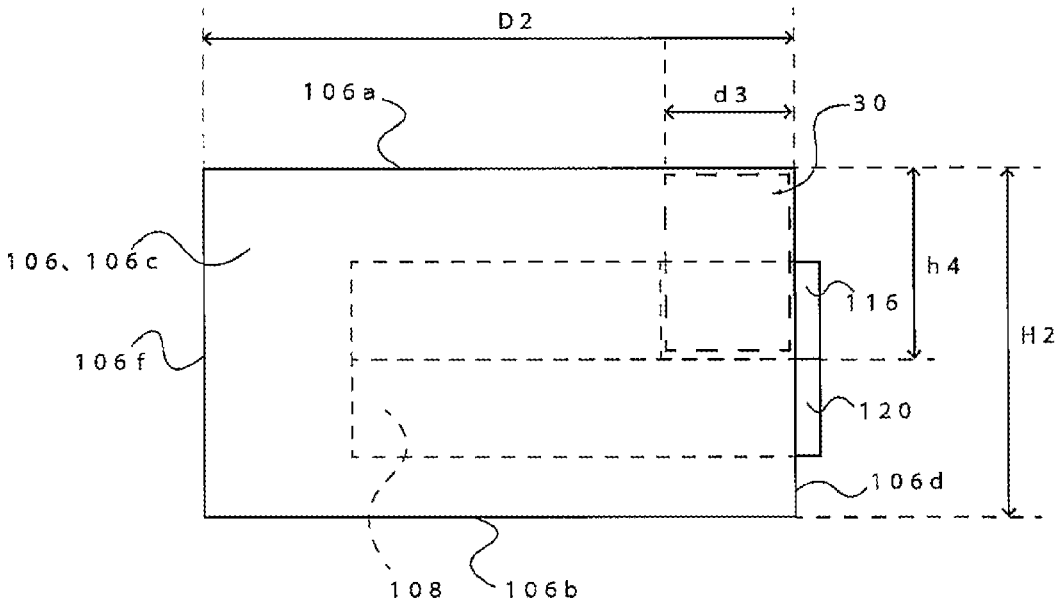
FIG. 15 is another side view for explanation of the coil and the third region of body of inductor of FIG. 10.

Next, referring to FIGS. 11 to 14, the distribution of the magnetic powder in the magnetic body 106 will be described by focusing on the magnetic powder content. FIG. 12 is a front view provided for explaining the coil 108 and the third region 30 of body 102 of inductor 101 of FIG. 10. FIG. 13 is a top view provided for explaining the coil 108 and the third region 30 of body 102 of inductor 101 of FIG. 10. FIGS. 14 and 15 are side views provided for explaining the coil 108 and the third region 30 of body 102 of inductor 101 of FIG. 10.

In the magnetic body 106, the third region 30 is disposed so as to include the corners formed by the longitudinal side surface 106*d* and the upper principal surface 106*a*. The magnetic powder content in the third region 30 is higher than that of rest of the magnetic body 106.

A length d3 of the third region 30 in the depth direction is ⅙ or more and ⅓ or less (i.e., from ⅙ to ⅓) of a length D2 of the magnetic body 106 in the depth direction (see FIGS. 12 to 14). A length w3 of the third region 30 in the width direction corresponds to a length W2 of the magnetic body 106 in the width direction (see FIGS. 11 and 12). The length of the third region 30 in the height direction is equal to or more than a length h3 from the upper principal surface 106*a* to the side surface 116*b* of the end portion 116 and is equal to or less than a length h4 (i.e., from a length h3 to a length h4) from the upper principal surface 106*a* to the side surface 120*b* of the end portion 120 (see FIGS. 11, 13, and 14).

Here, the length of the third region 30 in the height direction will be specifically described with reference to FIG. 12.

As illustrated in FIG. 12, the third region 30 is divided into three sections S1, S2, and S3 arranged in the width direction. The first section S1 extends from the lateral side surface 106*e* to a position at which the end portion 120 of the lead portion 118 starts to be exposed from the magnetic body 106. The second section S2 extends from the position at which the end portion 120 of the lead portion 118 starts to be exposed from the magnetic body 106 to the position at which the end portion 116 of the lead portion 114 starts to be exposed from the magnetic body 106. The third section S3 extends from the position at which the end portion 116 of the lead portion 114 starts to be exposed from the magnetic body 106 to the lateral side surface 106*c*.

The length of the third region 30 in the height direction varies in the three sections S1 to S3. In the first section S1, the length of the third region 30 in the height direction is a length h4 from the upper principal surface 106*a* to the side surface 120*b* of the end portion 120. In the third section S3, the length of the third region 30 in the height direction is a length h3 from the upper principal surface 106*a* to the side surface 116*b* of the end portion 116. In the second section S2, the length of the third region 30 in the height direction is reduced linearly from the length h4 at the end of the first section S1 to the length h3 at the end of the third section S3. Note that the length of the third region 30 in the height direction in the second section S2 is not limited to the linear reduction from the length h4 to the length h3 but may be, for example, a curvilinear reduction.

The magnetic powder content of the third region 30 is approximately 1% to 3% higher than that of other regions in the magnetic body 106.

Outer Electrode

A pair of outer electrodes (not illustrated) are disposed so as to cover the end portions 116 and 120 of respective lead portions 114 and 118. The outer electrodes cover respective lateral side surfaces 106*c* and 106*e*, part of each of the principal surfaces 106*a* and 106*b*, and part of each of the longitudinal side surfaces 106*d* and 106*f*. The end portions 116 and 120 are electrically connected to the corresponding outer electrodes.

Advantageous Effect

In the inductor 101 configured as above, the end portions 116 and 120 of respective lead portions 114 and 118 are both exposed from the longitudinal side surface 106*d* of the magnetic body 106, and one high magnetic powder content region is provided. As a result, the consumption of the magnetic powder can be reduced, and accordingly the manufacturing cost can be reduced compared with a case, for example, in which the end portions 116 and 120 are exposed from multiple side surfaces and multiple high magnetic powder content regions are provided as is the case for the inductor 1 of the first embodiment.

In the inductor 101, as described above, the lead portions 114 and 118 are both exposed from the longitudinal side surface 106*d* of the magnetic body 106, and one high magnetic powder content region is provided. The configuration of the inductor 101, however, is not limited to this. For example, the lead portions 114 and 118 may be exposed from one of the lateral side surfaces 106*c* and 106*e* of the magnetic body 106, and a high magnetic powder content region may be provided in the vicinity thereof. As a result, the consumption of the magnetic powder can be reduced further.

As described above, an indicator (such as the indicator 1 of the first embodiment and the indicator 101 of the second embodiment) includes a body (body 2, 102) that includes a magnetic body (magnetic body 6, 106) containing magnetic powder and a coil (coil 8, 108) embedded in the magnetic body. The coil has a winding portion (winding portion 10, 100) in which a conductive wire is wound around and a pair of lead portions (lead portions 14, 18, 114, 118) taken out from the winding portion. The inductor also includes a pair of outer electrodes (outer electrodes 4) formed on the body. In the inductor, the magnetic body includes principal surfaces (principal surfaces 6*a*, 6*b*, 106*a*, 106*b*) being opposite to each other and multiple side surfaces (side surfaces 6*c* to 6*f*, 106*c* to 106*f*) adjacent to the principal surfaces, and at least part of each of the lead portions is exposed from at least one side surface of the magnetic body and is coupled to a corresponding one of the outer electrodes. In addition, with respect to a position at which each of the lead portions is exposed from the one side surface of the magnetic body, a magnetic powder content in a region closer to one of the principal surfaces is higher than a magnetic powder content in a region closer to the other one of the principal surfaces.

First Manufacturing Method

Next, a method of manufacturing the inductor 1 according to the first embodiment will be described.

The method of manufacturing the inductor 1 according to the first embodiment includes (i) preparing a first preliminary compact 50 and a second preliminary compact 70, (ii) disposing the coil 8, (iii) forming the body 2, and (iv) disposing the outer electrodes 4.

Figure 16A:
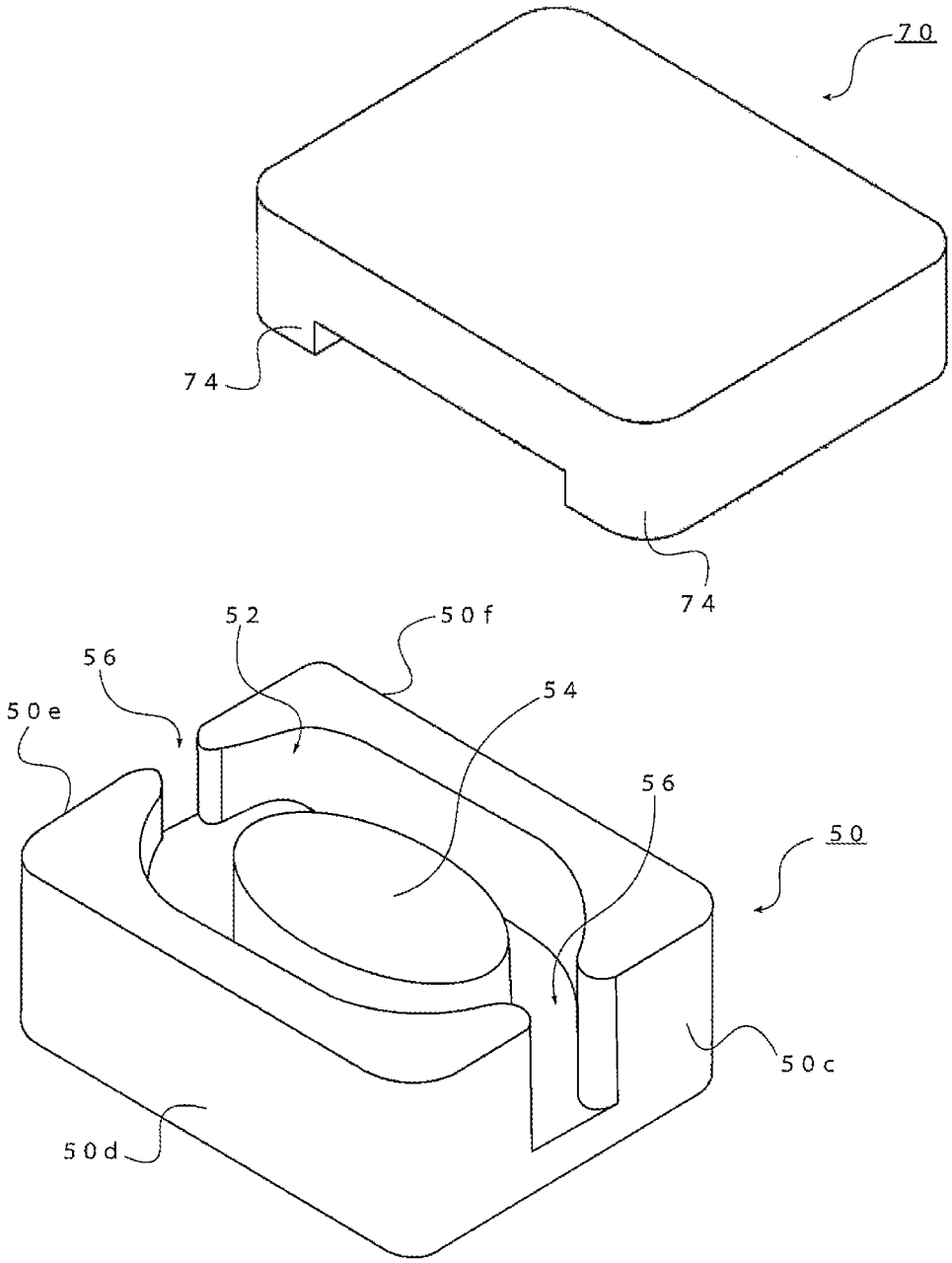
FIG. 16A is a perspective view for explanation of a preliminary compact of the inductor according to the first embodiment.
Figure 16B:
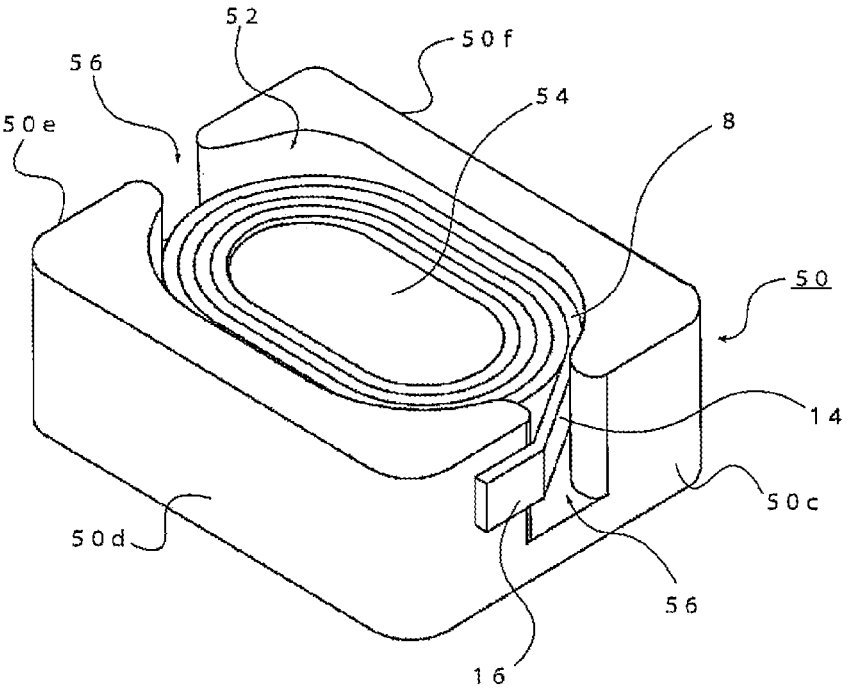
FIG. 16B is a perspective view for explanation of a process of manufacturing the inductor according to the first embodiment.
Figure 16C:
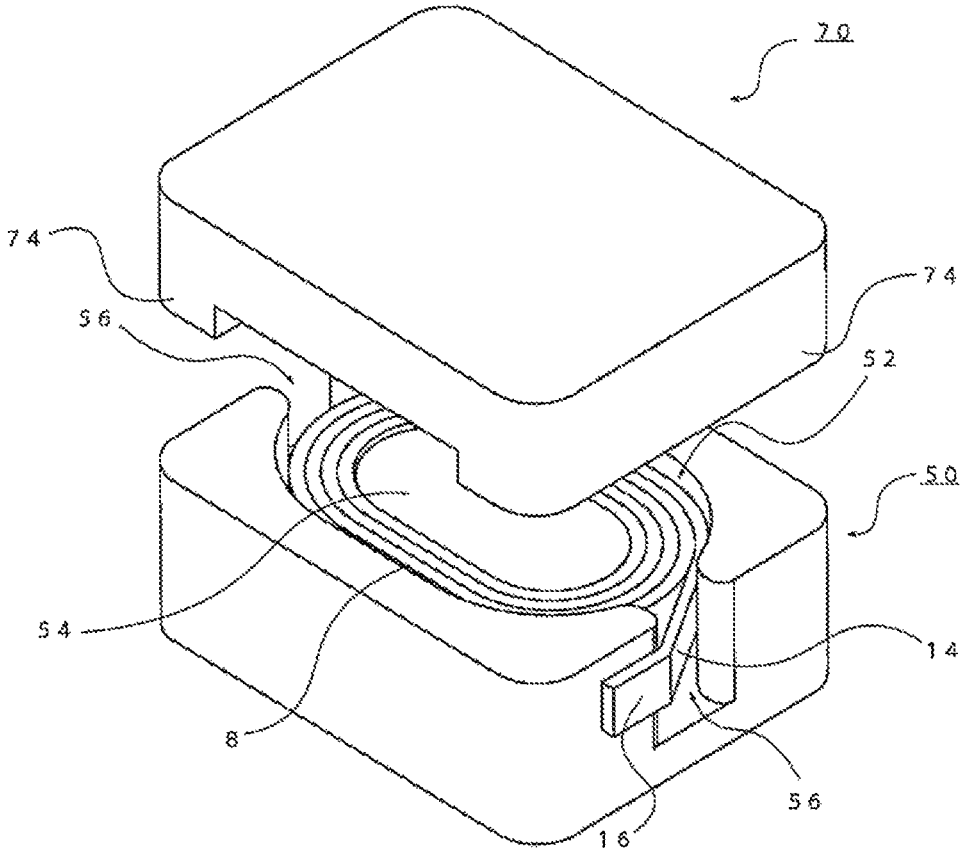
FIG. 16C is another perspective view for explanation of the process of manufacturing the inductor according to the first embodiment.
Figure 17:
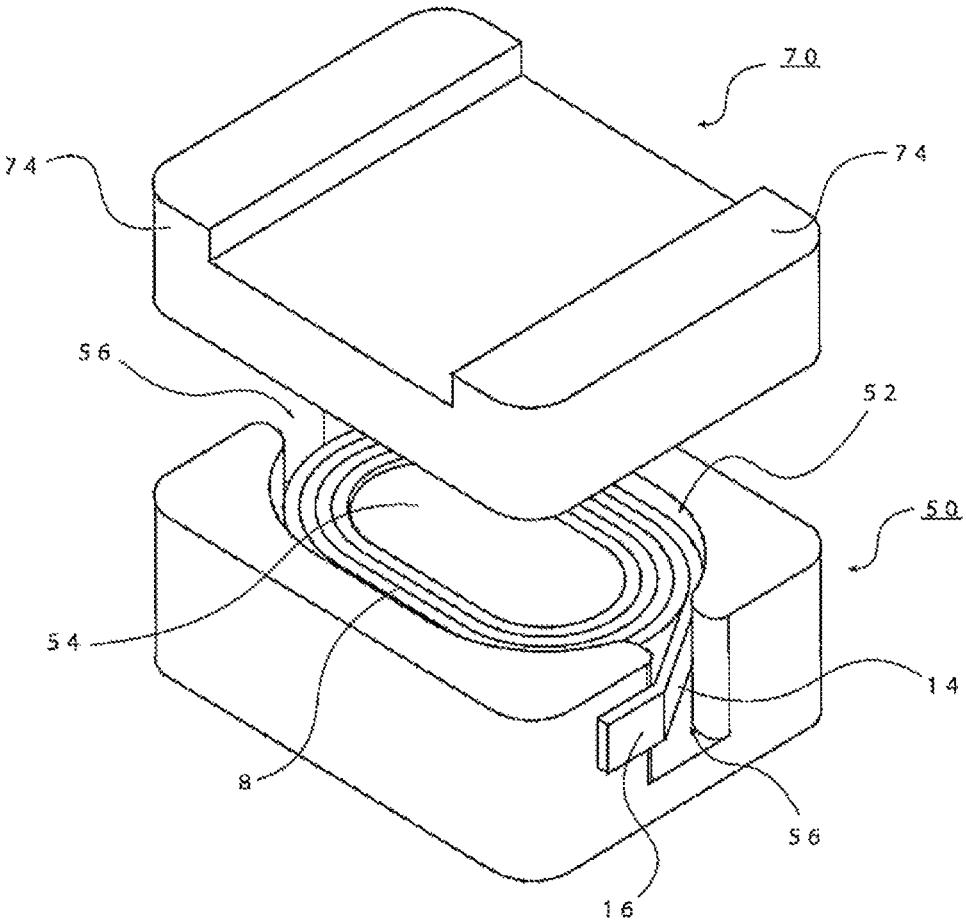
FIG. 17 is a perspective view for explanation of a manufacturing process in another method of manufacturing the inductor according to the first embodiment.

These steps will be described in detail with reference to FIGS. 16A to 16C and FIG. 17. FIG. 16A is a perspective view provided for explaining preliminary compacts of the inductor 1 according to the first embodiment, and FIGS. 16B to 16C are perspective views provided for explaining a manufacturing process of the inductor 1 according to the first embodiment. FIG. 17 is a perspective view provided for explaining a manufacturing process in another method of manufacturing the inductor according to the first embodiment.

Preparing First Preliminary Compact 50 and Second Preliminary Compact 70

In this step, a first preliminary compact 50 and a second preliminary compact 70 are prepared. As illustrated in FIG. 16A, the first preliminary compact 50 includes a recess 52, a winding core 54 disposed inside the recess 52, and notches 56 formed in opposing side walls defining the recess 52. The first preliminary compact 50 is made of a mixture of magnetic powder and resin. The second preliminary compact 70 is shaped like a flat plate and made of a mixture of magnetic powder and resin. The second preliminary compact 70 includes projection portions 74 at opposite ends thereof. The first preliminary compact 50 is shaped like a cuboid having longitudinal sides and lateral sides. The recess 52 opens at the upper surface of the first preliminary compact 50. The notches 56 are formed in lateral side walls 50*c* and 50*e* of the first preliminary compact 50. The second preliminary compact 70 is a flat plate with substantially rectangular principal surfaces having longitudinal sides and lateral sides. The projection portions 74 are disposed along the lateral sides of the second preliminary compact 70 and extend parallel to the lateral side surfaces thereof. The projection portions 74 project in the thickness direction of the flat plate. The projection portions 74 may project in the same direction or may project in the different directions. In other words, one of the projection portions 74 may project from the upper principal surface and the other one of the projection portions 74 may project from the lower principal surface. Alternatively, both of the projection portions 74 may project from the upper principal surface or from the lower principal surface of the flat plate (see FIG. 17). The projection portions 74 are thicker than the flat plate, having a thickness of 1% or more and 10% or less (i.e., from 1% to 10%) of the thickness of the flat plate. The first preliminary compact 50 and the second preliminary compact 70 have substantially the same lengths in the lateral direction and also in the longitudinal direction.

Disposing Coil 8

In this step, as illustrated in FIG. 16B, the coil 8 having the winding portion 10 and the lead portions 14 and 18 is disposed in the first preliminary compact 50. The winding portion 10 is formed so as to wind the conductive wire around. The winding portion 10 is disposed around the winding core 54 of the first preliminary compact 50 in such a manner that the inner circumferential surface of the winding portion 10 opposes the side surface of the winding core 54. Subsequently, the lead portions 14 and 18 that have been taken out from the winding portion 10 are further taken out of the first preliminary compact 50. The coil 8 is formed of the conductive wire (so-called flat wire) having a pair of opposite wide surfaces. The conductive wire has the conductor, the cover layer having insulation properties formed on the surface of the conductor, and the fusing layer formed on the surface of the cover layer. In the winding portion 10, the conductive wire is wound in upper and lower sections in such a manner that both end portions of the conductive wire are taken out from the outer circumference of the winding portion 10 and a portion of the conductive wire wound in the upper section is connected to a portion wound in the lower section at the inner circumference of the winding portion 10 (so-called "alpha-winding coil"). The lead portions 14 and 18 taken out from the outer circumference of the winding portion 10 are further taken out of the first preliminary compact 50 through respective notches 56. Subsequently, the end portions 16 and 20 of respective lead portions 14 and 18 taken out are disposed on outside surfaces of the corresponding lateral side walls 50*c* and 50*e* of the first preliminary compact 50. Here, the end portions 16 and 20 are disposed in such a manner that the width directions of the wide surfaces 16*a* and 20*a* of respective end portions 16 and 20 are made substantially parallel to the central axis of the winding core 54.

Forming Body 2

In this step, as illustrated in FIG. 16B, the first preliminary compact 50 in which the coil 8 is disposed is placed in a molding die. Here, the first preliminary compact 50 in which the coil 8 is disposed is placed in such a manner that the end portions 16 and 20 of respective lead portions 14 and 18 of the coil 8 are sandwiched between the outside surfaces of lateral side walls 50*c* and 50*e* of the first preliminary compact 50 and the inside surface of the molding die. The molding die is configured such that the width of the gap formed between the outside surfaces of the lateral side walls 50*c* and 50*e* and the inside surface of the molding die is substantially equal to or slightly wider than the thickness of the end portions 16 and 20.

Next, as illustrated in FIG. 16C, the second preliminary compact 70 is placed in the molding die so as to cover the recess 52 of the first preliminary compact 50. Here, the second preliminary compact 70 is placed such that the projection portions 74 of the second preliminary compact 70 oppose the notches 56 of the first preliminary compact 50.

Subsequently, the molding die is subjected to press molding (by applying pressure while heating). The body 2 in which the coil is embedded in the magnetic body containing magnetic powder is formed by press molding, and subsequently the body 2 is subjected to barrel polishing. As a result, the conductor surfaces of end portions 16 and 20 of the lead portions 14 and 18 are exposed on the lateral side surfaces 6*c* and 6*e*.

Disposing Outer Electrodes 4

In this step, a conductive resin having fluidity, such as a conductive paste, is applied, by dipping, to a portion of the body 2 that includes the lateral side surfaces 6*c* and 6*e* from which the end portions 16 and 20 are exposed and part of each of four surfaces 6*a*, 6*b*, 6*d*, and 6*f* that are adjacent to the lateral side surfaces 6*c* and 6*e*. Consequently, a pair of the outer electrodes 4 are formed by metal plating on top of the conductive resin applied. By the metal plating, a nickel layer on the conductive resin and a tin layer on the nickel layer are formed.

In the inductor 1 manufactured through these steps, the projection portions 74 of the second preliminary compact 70 are pressed largely in the step of forming the body 2, which produces the first region 22 and the second region 24 in which the magnetic powder content is higher.

Advantageous Effect

In the method of manufacturing the inductor 1 as described above, the second preliminary compact 70 is placed in the molding die in such a manner that the projection portions 74 of the second preliminary compact 70 oppose the notches 56 of the first preliminary compact 50. In this state, the first preliminary compact 50 and the second preliminary compact 70 are pressed against each other. The projection portions 74, or more specifically, the magnetic powder contained in the projection portions 74, serve as the supply material to be filled in the notches 56. Thus, the notches 56 are filled with the material containing the magnetic powder. As a result, the magnetic body 6 covers the entire portion of the coil 8 except for the end portions 16 and 20. Thus, the outer electrodes 4 are prevented from coming into contact with the coil 8 except for the end portions 16 and 20, which can reduce the likelihood of the inductor 1 being short-circuited. Filling the notches 56 with the material of the projection portions 74 suppresses generation of a region that is not filled with the magnetic powder and accordingly suppresses generation of a region that hampers the magnetic flux.

In addition, in the above-described method of manufacturing the inductor 1, when the first preliminary compact 50 is placed in the molding die, the width of the gap between the outside surfaces of the lateral side walls 50*c* and 50*e* of the first preliminary compact 50 and the inside surface of the molding die is substantially equal to or slightly wider than the thickness of the end portions 16 and 20. As a result, when the first preliminary compact 50 and the second preliminary compact 70 are pressed against each other in the molding die, the projection portions 74 of the second preliminary compact 70 can flow into the notches 56 of the first preliminary compact 50 relatively easily, and the notches 56 can be filled with the magnetic powder efficiently.

Alternative to First Manufacturing Method

Figure 18:
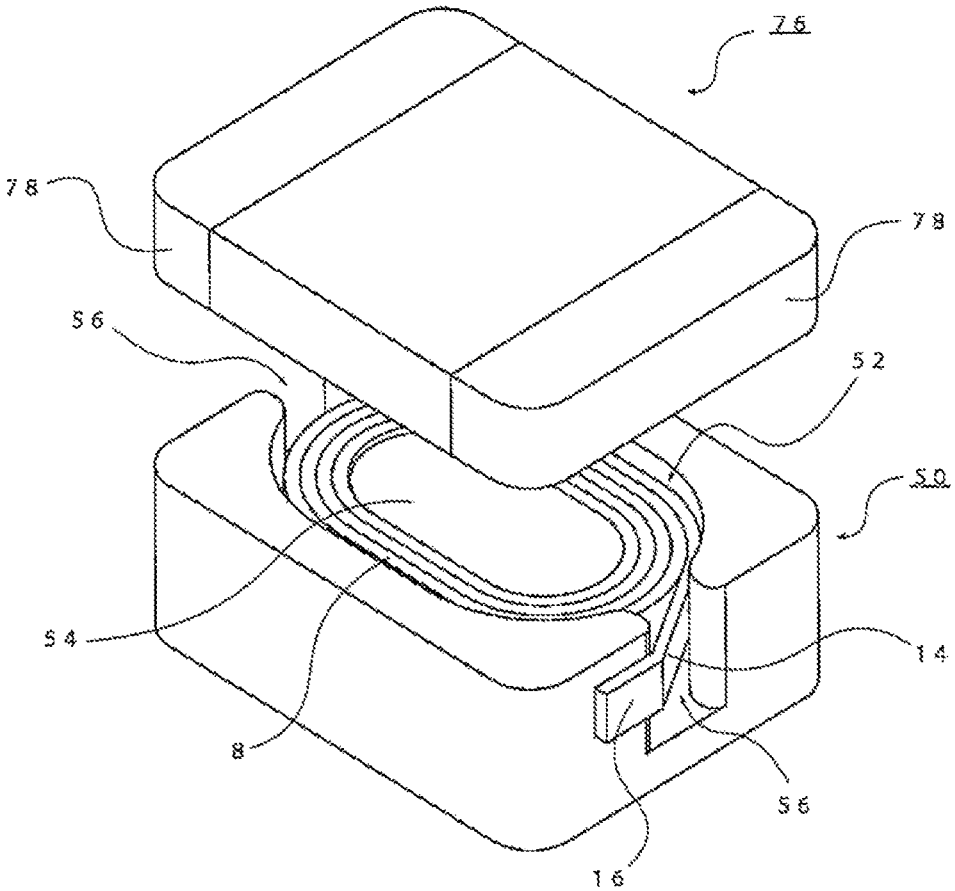
FIG. 18 is a perspective view for explanation of a manufacturing process in still another method of manufacturing the inductor according to the first embodiment.

In the step of preparing the first preliminary compact 50 and the second preliminary compact 70 in the above manufacturing method, the second preliminary compact 70 has the projection portions 74 formed at the ends thereof. However, the second preliminary compact 70 is not limited to this configuration. For example, as illustrated in FIG. 18, the second preliminary compact may be a flat plate having longitudinal sides and lateral sides, and regions of the flat plate along the lateral sides have a higher magnetic powder content than that of the other region. Regions 78 may have a magnetic powder content, for example, being approximately 1% to 3% higher than that of the other region of the second preliminary compact. In this case, the first preliminary compact 50 and the second preliminary compact 76 having the high magnetic powder content regions 78 have substantially the same lengths in the lateral direction and in the longitudinal direction.

In the case of the second preliminary compact 76 being used in the step of forming the body 2, the second preliminary compact 76 is placed in such a manner that the high magnetic powder content regions 78 are disposed so as to oppose the notches 56 when the second preliminary compact 76 covers the recess 52 of the first preliminary compact 50 in the molding die. The high magnetic powder content regions 78 forms the above-described first region 22 and second region 24 having a higher magnetic powder content.

Accordingly, when the first preliminary compact 50 and the second preliminary compact 76 are pressed against each other, the magnetic powder contained in the high magnetic powder content regions 78 serves as the supply material to be filled in the notches 56. Thus, the notches 56 are filled with the magnetic powder. As a result, the magnetic body 6 covers the entire portion of the coil 8 except for the end portions 16 and 20. Thus, the outer electrodes 4 are prevented from coming into contact with the coil 8 except for the end portions 16 and 20, which can reduce the likelihood of the inductor 1 being short-circuited. Filling the notches 56 with the magnetic powder contained in the high magnetic powder content regions 78 suppresses generation of a region that does not have a sufficient amount of the magnetic powder and accordingly suppresses generation of a region that hampers the magnetic flux.

In the above manufacturing method, the first preliminary compact 50 and the second preliminary compacts 70 and 76 have substantially the same lengths in the lateral direction and in the longitudinal direction. However, for example, the second preliminary compacts 70 and 76 may be formed so as to have the longitudinal lengths longer than the longitudinal lengths of the first preliminary compact 50. For example, the longitudinal lengths of the second preliminary compacts 70 and 76 may be longer by 3% to 4% than the longitudinal length of the first preliminary compact 50.

According to the above-described method of manufacturing the inductor 1, the sizes of the second preliminary compacts 70 and 76, especially the longitudinal lengths thereof, are greater than the size or the longitudinal length of the first preliminary compact 50. As a result, even if the first preliminary compact 50 and the second preliminary compact 70 or 76 are pressed against each other while the second preliminary compact 70 or 76 is displaced in the molding die, the magnetic powder contained in the projection portions 74 of the second preliminary compact 70 or the magnetic powder contained in the high magnetic powder content regions 78 of the second preliminary compact 76 can be filled in the notches 56.

Second Manufacturing Method

Next, a method of manufacturing the inductor 101 according to the second embodiment will be described.

The method of manufacturing the inductor 101 according to the second embodiment includes (i) preparing a first preliminary compact 150 and a second preliminary compact 170, (ii) disposing the coil 108, (iii) forming the body 102, and (iv) disposing the outer electrodes 4.

Figure 19:
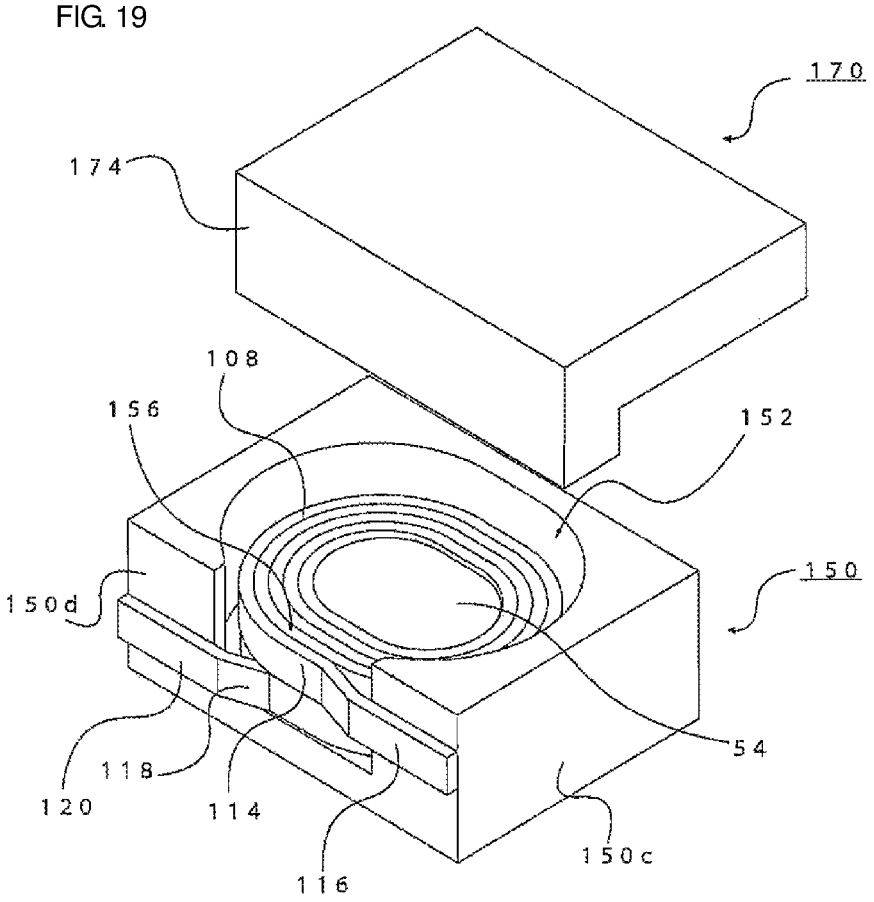
FIG. 19 is a perspective view for explanation of a process of manufacturing the inductor according to the second embodiment.

These steps will be described in detail with reference to FIG. 19. FIG. 19 is a schematic diagram provided for explaining a manufacturing process of the inductor 101 according to the second embodiment.

Preparing First Preliminary Compact 150 and Second Preliminary Compact 170

In this step, a first preliminary compact 150 and a second preliminary compact 170 are prepared. The first preliminary compact 150 includes a recess 152, a winding core 54 disposed inside the recess 152, and a notch 156 formed in a wall defining the recess 152. The first preliminary compact 150 is made of a mixture of magnetic powder and resin. The second preliminary compact 170 is shaped like a flat plate and made of a mixture of magnetic powder and resin. The second preliminary compact 170 includes a projection portion 174 at an end thereof. The first preliminary compact 150 is shaped like a cuboid having longitudinal sides and lateral sides. The recess 152 opens at the upper surface of the first preliminary compact 150. The notch 156 is formed in one longitudinal side wall 150*d* of the first preliminary compact 150. The second preliminary compact 170 is a flat plate with substantially rectangular principal surfaces having longitudinal sides and lateral sides. The projection portion 174 is formed along a longitudinal side of the second preliminary compact 170 and extend parallel to the longitudinal side surface thereof. The projection portion 174 projects in the thickness direction of the flat plate. The projection portion 174 is 1% or more and 10% or less (i.e., from 1% to 10%) thick than the thickness of the flat plate. The first preliminary compact 150 and the second preliminary compact 170 have substantially the same lengths in the lateral direction and also in the longitudinal direction.

Disposing Coil 108

In this step, the coil 108 having the winding portion 100 and the lead portions 114 and 118 is disposed in the first preliminary compact 150. The winding portion 100 is formed so as to wind the conductive wire around. The winding portion 100 is disposed around the winding core 54 of the first preliminary compact 150 in such a manner that the inner circumferential surface of the winding portion 100 opposes the side surface of the winding core 54. Subsequently, the lead portions 114 and 118 that have been taken out from the winding portion 100 are further taken out of the first preliminary compact 150. The coil 108 is formed of the conductive wire (so-called flat wire) having a pair of opposite wide surfaces. The conductive wire has the conductor, the cover layer having insulation properties formed on the surface of the conductor, and the fusing layer formed on the surface of the cover layer. In the winding portion 100, the conductive wire is wound in upper and lower sections in such a manner that both end portions of the conductive wire are taken out from the outer circumference of the winding portion 100 and a portion of the conductive wire wound in the upper section is connected to a portion wound in the lower section at the inner circumference of the winding portion 100 (so-called "alpha-winding coil"). The lead portions 114 and 118 taken out from the outer circumference of the winding portion 100 are further taken out of the first preliminary compact 150 through the notch 156. Subsequently, the end portions 116 and 120 of respective lead portions 114 and 118 taken out are disposed on the outside surface of the longitudinal side wall 150*d* of the first preliminary compact 150. Here, the end portions 116 and 120 are disposed in such a manner that the width directions of the wide surfaces 116*a* and 120*a* of respective end portions 116 and 120 are made substantially parallel to the central axis of the winding core 54.

Forming Body 102

In this step, the first preliminary compact 150 in which the coil 108 is disposed is placed in a molding die. Here, the first preliminary compact 150 in which the coil 108 is disposed is placed in such a manner that the end portions 116 and 120 of respective lead portions 114 and 118 of the coil 108 are sandwiched between the outside surface of the longitudinal side wall 150*d* of the first preliminary compact 150 and the inside surface of the molding die. The molding die is configured such that the width of the gap formed between the outside surface of the longitudinal side wall 150*d* and the inside surface of the molding die is substantially equal to or slightly wider than the thickness of the end portions 116 and 120.

Next, the second preliminary compact 170 is placed in the molding die so as to cover the recess 152 of the first preliminary compact 150. Here, the second preliminary compact 170 is placed such that the projection portion 174 of the second preliminary compact 170 oppose the notch 156 of the first preliminary compact 150.

Subsequently, the molding die is subjected to press molding (by applying pressure while heating). The body 102 in which the coil is embedded in the magnetic body containing magnetic powder is formed by press molding, and subsequently the body 102 is subjected to barrel polishing. As a result, the conductor surfaces of end portions 116 and 120 of the lead portions 114 and 118 are exposed on the longitudinal side surface 106*d*.

Disposing Outer Electrodes 4

In this step, a conductive resin having fluidity, such as a conductive paste, is applied, by dipping, to a portion of the body that includes the lateral side surfaces 106*c* and 106*e* and part of each of four surfaces 106*a*, 106*b*, 106*d*, and 106*f* that are adjacent to the lateral side surfaces 106*c* and 106*e* so as to cover the end portions 116 and 120 exposed from the longitudinal side surface 106*d*. Consequently, a pair of the outer electrodes 4 are formed by metal plating on top of the conductive resin applied. By the metal plating, a nickel layer on the conductive resin and a tin layer on the nickel layer are formed.

Advantageous Effect

In the method of manufacturing the inductor 101 as described above, the second preliminary compact 170 having a single projection portion 174 is used. As a result, the consumption of the magnetic powder can be reduced, and accordingly the manufacturing cost can be reduced compared with, for example, the manufacturing method of the inductor 1 according to the first embodiment in which the end portions are exposed from multiple side surfaces and multiple high magnetic powder content regions are provided.

Alternative to Second Manufacturing Method

Figure 20:
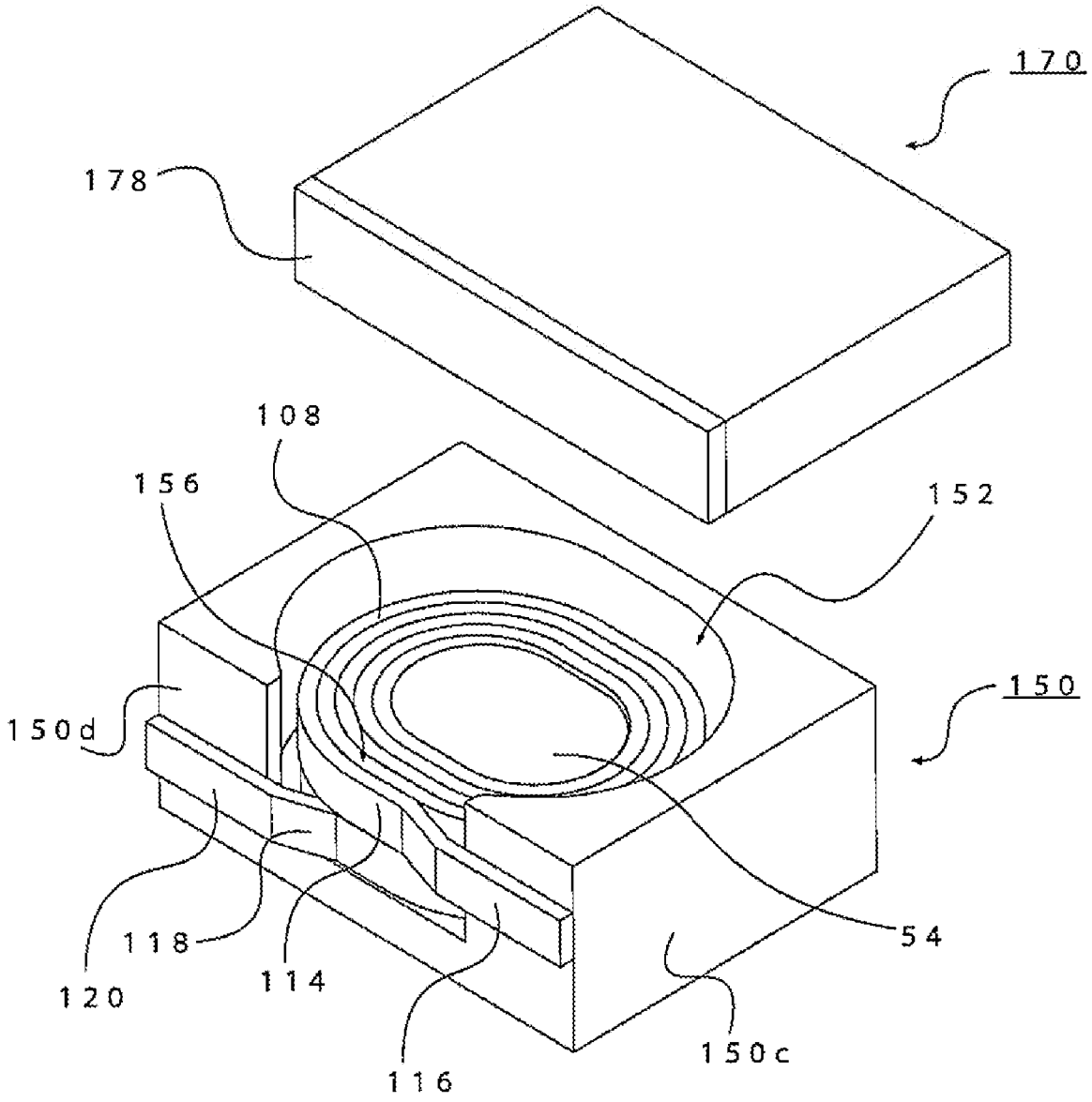
FIG. 20 is a perspective view for explanation of a manufacturing process in another method of manufacturing the inductor according to the second embodiment.

In the step of preparing the first preliminary compact 150 and the second preliminary compact 170 in the above-described manufacturing method, the second preliminary compact 170 has the projection portion 174 formed along an end thereof. However, the second preliminary compact 170 is not limited to this configuration. For example, as illustrated in FIG. 20, the second preliminary compact may be a flat plate having longitudinal sides and lateral sides, and a region of the flat plate extending along one of the longitudinal sides has a higher magnetic powder content than that of the other region. A region 178 may have a magnetic powder content, for example, being approximately 1% to 3% higher than that of the other region of the second preliminary compact. In this case, the first preliminary compact 150 and the second preliminary compact 170 having the high magnetic powder content region 178 also have substantially the same lengths in the lateral direction and in the longitudinal direction.

In the case of the second preliminary compact 170 being used in the step of forming the body 102, the second preliminary compact 170 is placed in such a manner that the high magnetic powder content region 178 is disposed so as to oppose the notch 156 when the second preliminary compact 170 covers the recess 152 of the first preliminary compact 150 in the molding die.

Accordingly, when the first preliminary compact 150 and the second preliminary compact 170 are pressed against each other, the high magnetic powder content region 178 provides the supply material to be filled in the notch 156. Thus, the notch 156 is filled with the magnetic powder contained in the high magnetic powder content region 178. As a result, the magnetic body 106 covers the entire portion of the coil 108 except for the end portions 116 and 120. Thus, the outer electrodes 4 are prevented from coming into contact with the coil 108 except for the end portions 116 and 120, which can reduce the likelihood of the inductor 101 being short-circuited.

In the above manufacturing method, the first preliminary compact 150 and the second preliminary compact 170 have substantially the same lengths in the lateral direction and in the longitudinal direction. However, for example, the second preliminary compact 170 may be formed so as to have the lateral length longer than the lateral length of the first preliminary compact 150. For example, the lateral length of the second preliminary compact 170 may be 3% to 4% longer than the lateral length of the first preliminary compact 150.

According to the above-described method of manufacturing the inductor 101, the size of the second preliminary compact 170, especially the lateral length thereof, is greater than the size or the lateral length of the first preliminary compact 150. As a result, even if the first preliminary compact 150 and the second preliminary compact 170 are pressed against each other while the second preliminary compact 170 is displaced in the molding die, the magnetic powder contained in the high magnetic powder content region 178 of the second preliminary compact 170 can be filled in the notch 156.

As described above, a method of manufacturing an inductor (i.e., the inductor 1 of the first embodiment or the inductor 101 of the second embodiment) includes (i) preparing a first preliminary compact (first preliminary compact 50, 150) and a second preliminary compact (second preliminary compacts 70, 76, 170), the first preliminary compact including a recess (recess 52, 152), a winding core (winding core 54) formed in the recess, and at least one notch (notch 56, 156) formed in at least one side wall defining the recess, the second preliminary compact being shaped like a flat plate and having at least one projection portion (projection portion 74, 174) extending along an edge of the second preliminary compact. The method also includes (ii) disposing, in a first preliminary compact, a coil that has a winding portion being formed so as to wind a conductive wire around and has lead portions being taken out from the winding portion, the coil being disposed in such a manner that the winding portion is disposed around the winding core and that end portions (end portions 16, 20, 116, 120) of the lead portions are taken out through the at least one notch and are disposed on at least one side surface of the first preliminary compact. The method further includes (iii) forming a body that includes a magnetic body having the coil embedded therein and containing magnetic powder, the body being formed by placing the second preliminary compact in such a manner that the second preliminary compact covers the recess of the first preliminary compact and the at least one projection portion opposes the at least one notch and by pressing the first preliminary compact and the second preliminary compact against each other in a molding die, and (iv) forming outer electrodes on surfaces of the body and coupling the outer electrodes to respective ones of the end portions.

In addition, another method of manufacturing an inductor (i.e., the inductor 1 of the first embodiment or the inductor 101 of the second embodiment) includes (i) preparing a first preliminary compact (first preliminary compact 50, 150) and a second preliminary compact (second preliminary compact 70, 76, 170), the first preliminary compact including a recess (recess 52, 152), a winding core (winding core 54) formed in the recess, and at least one notch (notch 56, 156) formed in at least one side wall defining the recess, the second preliminary compact being shaped like a flat plate and having at least one high magnetic powder content region (high magnetic powder content region 78, 178) extending along an edge of the second preliminary compact, the at least one high magnetic powder content region having a magnetic content higher than that of the other region. The method also includes (ii) disposing, in a first preliminary compact, a coil that has a winding portion being formed so as to wind a conductive wire around and has lead portions being taken out from the winding portion, the coil being disposed in such a manner that the winding portion is disposed around the winding core and that end portions (end portions 16, 20, 116, 120) of the lead portions are taken out through the at least one notch and are disposed on at least one side surface of the first preliminary compact. The method further includes (iii) forming a body that includes a magnetic body having the coil embedded therein and containing magnetic powder, the body being formed by placing the second preliminary compact in such a manner that the second preliminary compact covers the recess of the first preliminary compact and the at least one high magnetic powder content region opposes the at least one notch and by pressing the first preliminary compact and the second preliminary compact against each other in a molding die, and (iv) forming outer electrodes on surfaces of the body and coupling the outer electrodes to respective ones of the end portions.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a body including a magnetic body containing magnetic powder, the magnetic body including principal surfaces being opposite to each other and multiple side surfaces adjacent to the principal surfaces, and a coil embedded in the magnetic body, the coil including a winding portion in which a conductive wire is wound around and a pair of lead portions taken out from the winding portion; and a pair of outer electrodes provided on the body, wherein at least part of each of the lead portions is exposed from at least one side surface of the magnetic body, and is connected to a corresponding one of the outer electrodes, and on the at least one side surface of the magnetic body on which each of the lead portions is exposed, a magnetic powder content in a region of the magnetic body closer to one of the principal surfaces with respect to a position at which each of the lead portion is exposed is higher than a magnetic powder content in a region of the magnetic body other than the region closer to the one of the principal surfaces.

2. The inductor according to claim 1, wherein the high magnetic powder content region includes the at least one side surface from which each of the lead portions is exposed, and a length of the high magnetic powder content region in a direction of the magnetic body orthogonally intersecting the at least one side surface from which each of the lead portions is exposed is from ⅙ to ⅓ of a length of the magnetic body in the same direction of the magnetic body.

3. The inductor according to claim 1, wherein the principal surfaces of the magnetic body are rectangles each having longitudinal sides in a longitudinal direction and lateral sides in a lateral direction, and the at least one side surface from which each of the lead portions is exposed includes two side surfaces on lateral sides of the magnetic body.

4. The inductor according to claim 1, wherein the at least one side surface from which the lead portions are exposed includes one side surface of the magnetic body.

5. The inductor according to claim 2, wherein the principal surfaces of the magnetic body are rectangles each having longitudinal sides in a longitudinal direction and lateral sides in a lateral direction, and the at least one side surface from which each of the lead portions is exposed includes two side surfaces on lateral sides of the magnetic body.

6. The inductor according to claim 2, wherein the at least one side surface from which the lead portions are exposed includes one side surface of the magnetic body.

* * * * *